US009466283B2

(12) United States Patent
Yang et al.

(10) Patent No.: US 9,466,283 B2
(45) Date of Patent: Oct. 11, 2016

(54) SOUND ATTENUATING STRUCTURES

(71) Applicant: The Hong Kong University of Science and Technology, Hong Kong (CN)

(72) Inventors: Zhiyu Yang, Hong Kong (CN); Ping Sheng, Hong Kong (CN); Guancong Ma, Hong Kong (CN); Min Yang, Hong Kong (CN); Yong Li, Hong Kong (CN)

(73) Assignee: THE HONG KONG UNIVERSITY OF SCIENCE AND TECHNOLOGY, Hong Kong (CN)

( * ) Notice: Subject to any disclaimer, the term of this patent is extended or adjusted under 35 U.S.C. 154(b) by 0 days.

(21) Appl. No.: 14/772,968

(22) PCT Filed: Mar. 12, 2014

(86) PCT No.: PCT/CN2014/000252

§ 371 (c)(1),
(2) Date: Sep. 4, 2015

(87) PCT Pub. No.: WO2014/139323

PCT Pub. Date: Sep. 18, 2014

(65) Prior Publication Data

US 2016/0027427 A1 Jan. 28, 2016

Related U.S. Application Data

(60) Provisional application No. 61/851,653, filed on Mar. 12, 2013, provisional application No. 61/871,992, filed on Aug. 30, 2013, provisional application No. 61/964,635, filed on Jan. 10, 2014.

(51) Int. Cl.

| | |
|---|---|
| ***E04B 1/86*** | (2006.01) |
| ***G10K 11/175*** | (2006.01) |
| ***G10K 11/172*** | (2006.01) |

(52) U.S. Cl.

CPC ..... *G10K 11/175* (2013.01); *G10K 11/172* (2013.01)

(58) Field of Classification Search

CPC ..... G10K 11/172; E04B 1/86
USPC ..... 181/173, 167, 186, 290, 292, 284
See application file for complete search history.

(56) References Cited

U.S. PATENT DOCUMENTS 5,027,920 A * 7/1991 D'Antonio ..... E04B 1/8404 181/285
5,817,992 A * 10/1998 D'Antonio ..... E04B 1/8409 181/295

(Continued)

FOREIGN PATENT DOCUMENTS

| | | | |
|---|---|---|---|
| CN | 101151417 | A | 3/2008 |
| CN | 201425079 | Y | 3/2010 |
| JP | 2005017636 | A | 1/2005 |

OTHER PUBLICATIONS

Yang, Z., et al. "Acoustic Metamaterial Panels for Sound Attenuation in the 50/1000 Hz Regime"; Applied Physics Letters; Jan. 26, 2010; vol. 96.

*Primary Examiner* — Forrest M Phillips
(74) *Attorney, Agent, or Firm* — Nath, Goldberg & Meyer; Jerald L. Meyer; Stanley N. Protigal

(57) ABSTRACT

A sound attenuation panel is configured with a substantially acoustically transparent planar, rigid frame divided into a plurality of individual, substantially two-dimensional cells. A sheet of a flexible material is fixed to the rigid frame, and a plurality of platelets fixed to the sheet of flexible material such that each individual cell of the plurality of cells is provided with a respective platelet to establish a resonant frequency, the resonant frequency defined by the planar geometry of the individual cells, the flexibility of the flexible material and the platelets. The cells are divided into at least two different types of the individual cells, configured so that sound waves emitted by a first type of said different types of individual cells establishes a sound cancellation pattern with sound waves emitted by a second type of said different individual cells or an aggregation of different types of the individual cells.

27 Claims, 20 Drawing Sheets

305

(56) References Cited

U.S. PATENT DOCUMENTS 6,112,852 A * 9/2000 D'Antonio ..... G10K 11/16 181/295
6,576,333 B2 6/2003 Sheng et al.
6,929,092 B2 * 8/2005 Abe ..... H04R 7/122 181/167
7,249,653 B2 7/2007 Sheng et al.
7,314,114 B2 * 1/2008 Gardner ..... G10K 11/20 181/284
7,395,898 B2 * 7/2008 Yang ..... G10K 11/172 181/286
8,579,073 B2 11/2013 Sheng et al.
8,869,933 B1 * 10/2014 McKnight ..... G10K 11/172 181/207
2005/0194209 A1 * 9/2005 Yang ..... G10K 11/172 181/286
2016/0071507 A1 * 3/2016 Kim ..... G10K 11/172 181/286

* cited by examiner

SOUND ATTENUATING STRUCTURES

This is a National Phase Application filed under 35 U.S.C. 371 as a national stage of PCT/CN2014/000252, filed Mar. 12, 2014, an application claiming the benefit of U.S. Application No. 61/851,653, filed Mar. 12, 2013, U.S. Application No. 61/871,992, filed Aug. 30, 2013, and U.S. Application No. 61/964,635, filed Jan. 10, 2014, the content of each of which is hereby incorporated by reference in its entirety.

BACKGROUND

1. Field

This disclosure relates to novel sound attenuating structures, and in particular to locally resonant sonic materials (LRSM) that are able to provide a shield or sound barrier against a particular frequency range and which can be stacked together to act as a broad-frequency sound attenuation shield.

2. Background

In recent years, a new class of sonic materials has been discovered, based on the principle of structured local oscillators. Such materials can break the mass density law of sound attenuation, which states that in order to attenuate sound transmission to the same degree, the thickness, or mass per unit area, of the solid panel has to vary inversely with the sound frequency. Thus with the conventional sound attenuation materials low frequency sound attenuation can require very thick solid panels, or panels made with very high density material, such as lead.

The basic principles underlying this new class of materials, denoted as locally resonant sonic materials (LRSMs) have been published in Science, vol. 289, p. 1641-1828 (2000), and such materials are also described in U.S. Pat. No. 6,576,333, and U.S. Pat. No. 7,249,653 on the various designs for the implementation of this type of LRSM. Current designs still suffer from the fact that the breaking of the mass density law is only confined to a narrow frequency range. Thus in applications requiring sound attenuation over a broad frequency range, the LRSM can still be fairly thick and heavy.

Conventional means of blocking airborne sound usually requires blocking the air medium with a solid material. This has a disadvantage for noise blocking applications where air ventilation is also required.

U.S. Pat. No. 7,395,898 to Yang, et al., describes a sound attenuation panel comprising, a rigid frame divided into a plurality of individual cells, a sheet of a flexible and elastic material (membrane), and a plurality of weights (platelets). Each weight is fixed to the sheet of flexible material such that each cell is provided with a respective weight and the frequency of the sound attenuated can be controlled by suitably selecting the mass of the weight. In such sound attenuating structures, in the membrane-weight unit cells distributed on a planar panel are all substantially identical. In one type of system as described in U.S. Pat. No. 7,395,898, the membrane is typically rubber or another elastomer, and the weight has mass between 0.1 to 10 g.

U.S. Pat. No. 8,579,073 to Sheng, et al. describes an acoustic energy absorption metamaterial that includes at least one enclosed planar frame with an elastic membrane attached and has one or more rigid plates are attached to the membrane. The rigid plates have asymmetric shapes, with a substantially straight edge at the attachment to said elastic membrane, so that the rigid plate establishes a cell having a predetermined mass. Vibrational motions of the structure contain a number of resonant modes with tunable resonant frequencies.

In configuring resonant metamaterials, structures in which the membrane-weight unit cells distributed on a planar panel have been identical. Given a particular membrane material, e.g., rubber, the weight would have a defined mass. This results in a working frequency within a particular range as determined by the mass, moment of the displaced mass and Hooke's law.

SUMMARY

A sound attenuation panel has a substantially transparent planar, rigid frame, divided into plural individual substantially two-dimensional cells. A sheet of a flexible material is fixed to the rigid frame, and a plurality of platelets are fixed to the sheet of flexible material such that each individual cell of the plurality of cells is provided with a respective platelet. The arrangement of the flexible material with the platelets establishes a resonant frequency defined by the planar geometry of the respective individual cells, the flexibility of the flexible material and the respective platelet thereon. The plurality of cells are divided into at least two different types of the individual cells, distributed on the sound attenuation panel. The different types of individual cells are configured so that sound waves emitted by a first type of said different types of individual cells establishes a sound cancellation pattern with sound waves emitted by a second type of said different individual cells or with an aggregation of different types of the individual cells.

BRIEF DESCRIPTION OF THE DRAWINGS

FIG. 11A is a graphical depiction of absorption properties of a unit cell. FIG. 11B is a graphical depiction of amplitude vs. position taken at 172 Hz. for the sample depicted in FIG. 11A. FIG. 11C is a graphical depiction of amplitude vs. position taken at 340 Hz. for the sample depicted in FIG. 11A. FIG. 11D is a graphical depiction of amplitude vs. position taken at 710 Hz. for the sample depicted in FIG. 11A. FIG. 11E is a photo image of the sample unit cell described in the graphs of FIGS. 11A-11D.

FIG. 15A shows the measured absorption coefficient for a 2 layer sample. FIG. 15B is a photographic image of the structure.

FIG. 21A depicts numerical simulations of the structures with Acrylonitrile Butadiene Styrene (ABS) membrane, with ABS membrane radius=50 mm, thickness=0.1 mm, Pb platelet radius=8 mm, thickness=1.1 mm. FIG. 21B depicts numerical simulations of the structures with Acrylonitrile Butadiene Styrene (ABS) membrane with ABS membrane radius=100 mm, thickness=0.5 mm, ABS platelet radius=40 mm, thickness=2.25 mm.

FIG. 24A depicts an alternating arrangement of cells. FIG. 24B depicts an arrangement in which the alternating arrangement is such that the closest cell of the same type is more remote than the closest cell of the opposite type. FIG. 24C depicts an arrangement in which cells of the same type are arranged adjacently per-row. FIG. 24D depicts an arrangement in which cells of one type are surrounded by cells of a different type. FIG. 24E depicts an arrangement in which the alternating arrangement provides adjacent relationships between cells of one type but not between cells of another type, and provides separation by row.

FIG. 28A is a side view and FIG. 28B is a top or plan view.

FIG. 29A is a side view and FIG. 29B is a top or plan view.

DETAILED DESCRIPTION

Overview

Figure 1:
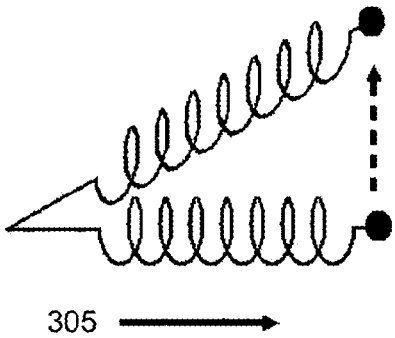
FIG. 1 is an illustration of mass displacement transverse to a spring.

The term "metamaterials" denotes the coupling to the incident wave to be resonant in character. In an open system, radiation coupling to resonance is an alternative that can be effective in reducing dissipation. While the advent of acoustic metamaterials has broadened the realm of possible material characteristics, as yet there are no specific resonant structures targeting the efficient and subwavelength absorption of low frequency sound. In contrast, various electromagnetic metamaterials designed for absorption have been proposed, and an "optical black hole" has been realized by using metamaterials to guide the incident wave into a lossy core.

It has been found that by using thin flexible and elastic membranes or sheets decorated with or affixed with designed patterns of rigid platelets, the resulting acoustic metamaterials can absorb 86% of the acoustic waves at ~170 Hz, with two layers absorbing 99% of the acoustic waves at the lowest frequency resonant modes, as well as at the higher frequency resonant modes. The platelets each have a predefined weight or mass. As used herein, "platelets", "weights" and "masses" are used interchangeably. The sample is thus acoustically "dark" at those frequencies. Finite-element simulations of the resonant mode patterns and frequencies are in excellent agreement with the experiments. In particular, laser Doppler measurements of resonant modes' displacement show discontinuities in its slope around platelets' perimeters, implying significantly enhanced curvature energy to be concentrated in these small volumes that are minimally coupled to the radiation modes; thereby giving rise to strong absorption similar to a cavity system, even though the system is geometrically open.

As used herein, the term "membrane" or "sheet" shall include a thin sheet of material which, by way of non-limiting example, can be a flexible and elastic membrane or sheet.

According to the present disclosure, a sound attenuation panel is formed with a rigid frame, a sheet of a flexible material, and a plurality of platelets. The rigid frame is divided into a plurality of individual cells. The flexible material may be any suitable soft material such as an elastomeric material like rubber, or a material such as nylon. In one aspect, the flexible material should have a thickness of less than about 1 mm.

In one configuration, the flexible material should be impermeable to air and without any perforations or holes; otherwise the effect is significantly reduced. In an alternate configuration, the panel is constructed to have openings and is not air tight, permitting air to flow through the panel rather freely. In such an arrangement, the sound blocking panels comprise sizable orifices or openings through which air can flow freely sufficiently for providing or promoting air ventilation.

The rigid frame, also referred to as the grid, may be made of a material such as aluminum or plastic. The function of the grid is for support and therefore the material chosen for the grid is not critical provided it is sufficiently rigid and preferably lightweight.

Typically the spacing of the cells within the grid is in the region of 0.5-1.5 cm. In some cases, in particular if the flexible sheet is thin, the size of the grid can have an effect on the frequency being blocked, and in particular the smaller the grid size, the higher the frequency being blocked. Nevertheless, the effect of the grid size becomes less significant if the flexible sheet is thicker.

A typical dimension for one of the platelets is around 5 mm with a mass in the range of 0.2 to 2 g. Generally all the platelets in one panel will have the same mass and the mass of the platelet is chosen to achieve sound attenuation at a desired frequency, and if all other parameters remain the same, the frequency blocked will vary with the inverse square root of the mass. The dimensions of the platelets are not critical in terms of the frequency being blocked, but they may affect the coupling between the incoming sound and the resonant structure. A relatively "flat" shape for the platelet may be used, and hence a headed screw and nut combination is quite effective. Another possibility is that the platelet may be formed by two magnetic components (such as magnetic discs) that may be fixed to the membrane without requiring any perforation of the membrane, instead one component could be fixed on each side of the membrane with the components being held in place by their mutual attraction.

A single panel may attenuate only a relatively narrow band of frequencies; however, a number of panels may be stacked together to form a composite structure. In particular if each panel is formed with different platelets and thus attenuating a different range of frequencies, the composite structure may therefore have a relatively large attenuation bandwidth.

The disclosed technology also extends to a sound attenuation structure comprising a plurality of panels stacked together in which each panel comprises a rigid frame divided into individual cells, a sheet of a soft material, and multiple platelets. Each platelet is fixed to the sheet of soft material such that each cell is provided with its own respective platelet. The technique also extends to a sound attenuation structure in which a rigid frame is divided into individual cells, a sheet of a soft material, and multiple platelets. Each platelet is fixed to the sheet of soft material such that each cell is provided with a respective platelet.

An individual sound attenuating panel as described above is generally sound reflecting. If it is desired to reduce the sound reflection then a panel as described above may be combined with a known sound absorbing panel.

In another configuration, the disclosed technology relates to a new type of locally resonant sonic materials (LRSM) design. Basically, the local oscillators can be regarded as composed of two components: 1) the mass m of the oscillator, and 2) the spring K of the oscillator. In many cases, m is not increased because increasing m will increase the overall weight of the panels. Hence one may choose to lower K. A lower K is usually associated with soft materials, which would make the sound attenuating panel more difficult to sustain structurally. According to one aspect of the disclosed technology, a lower K is achieved through geometric means rather than relying primarily on the use of soft elastic materials.

When sound waves are incident onto an elastic panel, they excite the vibration motion of the panel. The vibrating panel serves as a sound source, generating sound waves on the other side of the panel. The net result is that the sound waves have transmitted through the panel, which is what we want to reduce to the smallest value possible for noise blocking panels. By providing two types of cells, the generated sound waves can cancel each other out. At least two types of cells can be used. By way of non-limiting example, two types of cells are provided. A thin elastic membrane or sheet is attached to cells of one type (type-A cells), on which a small platelet is attached, while other cells (type-B cells) have a different platelet attached or are completely empty. Optionally, the sound blocking panels comprise sizable orifices or openings through which air can flow freely sufficiently for providing or promoting air ventilation.

The thin elastic membrane is attached to each type of cells. In the case of two types of cells, the thin elastic membrane is attached to type-A cells and type-B cells. The platelet attached on one set of cells (e.g., type-A cells) is different from that on a second or subsequent set of cells (e.g., type-A cells in combination with type-B cells or type-A cells in combination with type-B cells, type-C cells, type-D cells, etc). Alternatively, unit cells may differ in geometric shape and/or size. The material of membranes, as well as the pre-stress applied, may also be different. The shape and/or size of the platelet or any decoration on the membrane may also be different.

For both types of panels, each type of cell (e.g., type-A cells and type-B cells) are arranged intermittently in the repeating patterns, but not limited to specific patterns.

Cells of one type (e.g., type-A cells) will emit sound waves which are out of phase to those emitted by cells of other types (e.g., type-B cells). These sound waves then cancel each other, resulting in minimum transmission, when the wavelength in air is much larger than the cell size. In the present cases, the cell size is about 1.0 cm, and the wavelength is of the order of 100 cm. However, other cell sizes are contemplated within the scope of the present disclosure. Some experimental results are shown below as supporting evidence for the cells having the above size. The frequency of the incident sound wave is close to the resonant frequency of one type of cells, but significantly different from that of the other type. As a result, the two types of cells will have opposite phase in vibration, and the resultant sound wave re-emitted significantly attenuated.

Rather than producing a sound attenuating structure in which the membrane-platelet unit cells distributed on a planar panel are all identical, multiple types of unit cells are provided. In such an arrangement, two or more types of unit cells (type-A, B, C, D, etc.) are distributed alternatively on the planar panel. At some particular frequency range, the vibration of cells of one type (type-A cells) is in opposite phase as the other types (B-type, C-type, D-type, etc.). Consequently, the sound waves emitted by type-A cells cancel that by those emitted by type-B, C, D, etc. cells via wave interference, so that the incident sound waves onto the panel are effectively blocked, resulting in a passive effect. Pushing the situation to a logical extreme, cells of one type can be completely empty. The passive effect is similar to that achieved in electronic Active Noise Reduction (ANR), but using different resonant frequencies. Instead of driving the acoustics directly in an out-of-phase relationship as achieved by electronic ANR, the out-of-phase relationship is achieved by using two or more cell types that have resonant frequencies that significantly differ from one another.

The basic principle here is the cancellation of the in-phase and out-of-phase motions of the neighboring cells at the frequency of transmission minimum. This can lead to an overall cancellation of the net, averaged air motion on the other side of the membrane, so that when viewed as an aggregated source there is no net transmitted energy at the transmission minimum.

As compared to earlier LRSM configurations implementing a membrane reflector, the present configuration provides advantages in regard to the loading on the frame. That is, in actual large-area applications it is necessary to use a frame which serves the purpose of assembling the individual membrane panels into a sound attenuation wall. In such situation if every membrane panel is identical, then at the total reflection frequency the loading on the frame can be very large, thereby leading to frame deformation and leaking of the low frequency sound. In the present configuration, since the type-A cell and the type-B cell can be out of phase, their net loading on the frame may be minimized, so that there will be minimal low frequency sound leakage.

Conventional means of blocking airborne sound usually requires blocking the air medium with a solid material. Using the panels, one can have sound blocking panels with sizable orifices through which air can flow freely, making them a viable approach for noise blocking applications where air ventilation is also required.

In a particular configuration, a structure of the membrane is chosen which enhances the flexibility of the membrane. By choosing the right thickness and elasticity, such as the Young's modulus and the Poisson ratio, of the membrane, the mass and dimension of the platelet, and the cell dimension, working frequencies in the range from subsonic (below 1 Hz) to ultrasonic (above 1 MHz) can be covered.

As a non-limiting example, a sound blocking panel includes a grid of 2D array of cells. Each cell includes a membrane with its boundary fixed on the cell walls, and a platelet is fixed at the center of the membrane. In many systems, such as described in U.S. Pat. No. 7,395,898, the membrane is typically rubber or another elastomer, and the platelet has mass between 0.1 to 10 g, and the working frequency is in the low frequency regime below 1500 Hz. In contrast, the materials for the membrane as presently disclosed can include a wide variety solid materials, and by proper selection of membrane materials, thickness, and lateral dimension, and the mass and dimension of the central platelet, the above-described sound attenuation structures with working frequencies from below 1 Hz to beyond 1 MHz can be created.

Mass Displacement on Membranes

Consider the usual mass-spring geometry whereby the mass displacement x is equal to the spring displacement, so that the restoring force is given by Kx. Consider the case in which the mass displacement is transverse to the spring as shown in FIG. 1. In that case the mass displacement x will cause a spring elongation in the amount of $(\frac{1}{2})*l*(x/l)^2=x^2/2l$, where l is the length of the spring. Thus the restoring force is given by $Kx*(x/2l)$. Since x is generally very small, the effective spring constant $K'=K*(x/2l)$ is thus significantly reduced. The local oscillator's resonance frequency is given by:

$$f = \frac{1}{2\pi}\sqrt{\frac{K'}{m}}$$

It follows that a weak effective K' would yield a very low resonance frequency. Thus it is possible to use a lighter mass m in the design and still achieve the same effect.

The above discussion applies to extreme cases where the diameter of the spring, or rather that of an elastic rod, is much smaller than its length l. When the diameter is comparable to l, the restoring force is proportional to the lateral displacement x and the force constant K' would hence be independent of x. For medium-range diameters K' changes gradually from independent of x to linearly dependent on x, i.e., the x-independent region of the displacement gradually shrinks to zero. In two-dimensional configurations, this corresponds to a mass on an elastic membrane with thickness ranging from much smaller than the lateral dimension to comparable to it. The effective force constant K' depends on the actual dimensions of the membrane as well as the tension on the elastic membrane. All these parameters can be adjusted to obtain the desired K' to match the given mass, so as to achieve the required resonance frequency. For example, to reach higher resonance frequency one could use either lighter platelets, or increase the K' of the membrane by stacking two or more membranes together, the effect of which is the same as using a single but thicker membrane. The resonance frequency may also be adjusted by varying the tension in the membrane when it is secured to the rigid grid. For example if the tension of the membrane is increased then the resonance frequency will also increase.

Figure 2:
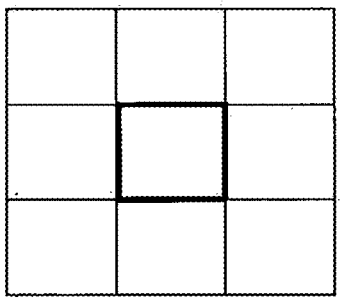
FIG. 2 illustrates a rigid frame comprising a number of locally resonant sonic material (LRSM) cells with a single cell being delineated by bold lines.

FIG. 2 is a diagram showing an example of a rigid grid and divided into nine identical cells, with the central cell highlighted for clarity. The grid may be formed of any suitable material provided it is rigid and preferably lightweight. Suitable materials for example include aluminum or plastic. Typically the cells are square with a length of the sides being around 0.5 to 1.5 cm.

Figure 3:
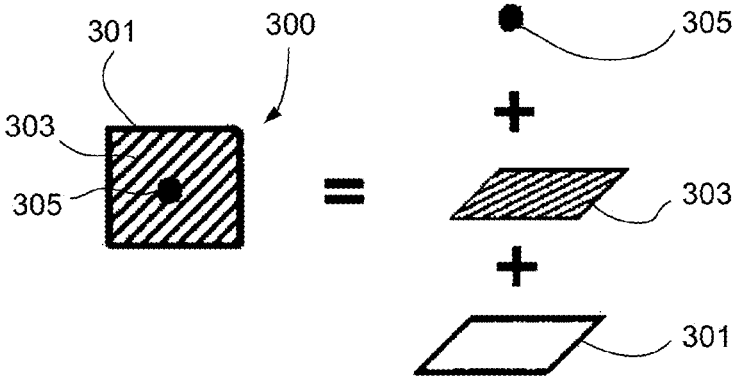
FIG. 3 is a diagram showing a single cell with a top view and in an exploded view.

FIG. 3 is a diagram showing a single cell with a top view and an exploded view of a cell 300. As described above, the locally resonant sonic materials (LRSM) panels are formed of a rigid frame 301, over which is fixed a soft material such as a thin rubber sheet 303. In each of the cells 300, a small platelet 305 can then be fixed to the center of the rubber sheet 303.

The frame can have a small thickness. In this manner, when a sound wave in the resonance frequency range impinges on the panel, a small displacement of the platelet will be induced in the direction transverse to the rubber sheet. The rubber sheet in this case acts as the weak spring for the restoring force. As a single panel can be very thin, a multitude of sonic panels can be stacked together to act as a broad-frequency sound attenuation panel, collectively breaking the mass density law over a broad frequency range.

Figure 4:
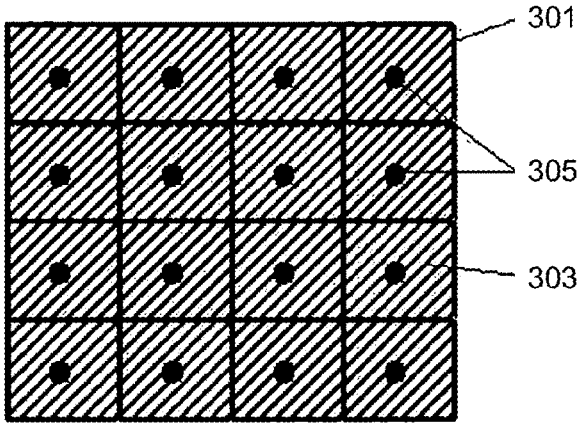
FIG. 4 is a schematic diagram showing a top view of a locally resonant sonic material (LRSM) panel.

As shown in FIG. 4, an LRSM panel according to an embodiment of the disclosed technology comprises a plurality of individual cells, with each cell being formed of three main parts, namely the grid frame 301, a flexible sheet such as an elastomeric (e.g. rubber) sheet 302, and a platelet 303. The hard grid provides a rigid frame onto which the platelets (which act as the local resonators) can be fixed. The grid itself is almost totally transparent to sound waves. The rubber sheet, which is fixed to the grid (by glue or by any other mechanical means) serves as the spring in a spring-mass local oscillator system. A screw and nut combination may be fastened onto the rubber sheet at the center of each grid cell to serve as the platelet.

The flexible sheet may be a single sheet that covers multiple cells, or each cell may be formed with an individual flexible sheet attached to the frame. Multiple flexible sheets may also be provided superimposed on each other, for example two thinner sheets could be used to replace one thicker sheet. The tension in the flexible sheet can also be varied to affect the resonant frequency of the system.

The resonance frequency (natural frequency) of the system is determined by the mass m and the effective force constant K of the rubber sheet, which is equal to the rubber elasticity times a geometric factor dictated by the size of the cell and the thickness of the rubber sheet, in a simple relation:

$$f = \frac{1}{2\pi}\sqrt{\frac{K'}{m}}$$

If K is kept constant, the resonance frequency (and therefore the frequency at which transmission is minimum) is proportional to $$\sqrt{\frac{1}{m}}$$

This can be used to estimate the mass needed to obtain the desired dip frequency.

Four samples of LRSM panels made in accordance with the design of FIG. 4 were constructed for experimental purposes with the following parameters, producing the results depicted in FIGS. 5-8, which are a graphic diagrams showing the transmission spectra of the LRSM panels.

Sample 1

The panel of Sample 1 includes two grids with one grid superimposed on the other and the grids being fixed together by cable ties. Each cell is square with sides of 1.5 cm and the height of each grid is 0.75 cm. Two rubber sheets (each 0.8 mm thick) are provided with one sheet being held between the two grids, and the other sheet being fixed over a surface of the panel. Both sheets are fixed to the grids without any prior tension being applied. A platelet is attached to each rubber sheet in the center of the sheet in the form of a stainless steel screw and nut combination. In Sample 1 the weight of each screw/nut combination is 0.48 g.

Sample 2

The panel of Sample 2 is identical to Sample 1 except that the weight of each screw/nut combination is 0.76 g.

Sample 3

The panel of Sample 3 is identical to Sample 1 except that the weight of each screw/nut combination is 0.27 g.

Sample 4

The panel of Sample 4 is identical to Sample 1 except that the weight of each screw/nut combination is 0.136 g and the screw/nut combination is formed of Teflon® (registered trademark of E.I. duPont de Nemours for polytetrafluoroethylene polymer).

Figure 5:
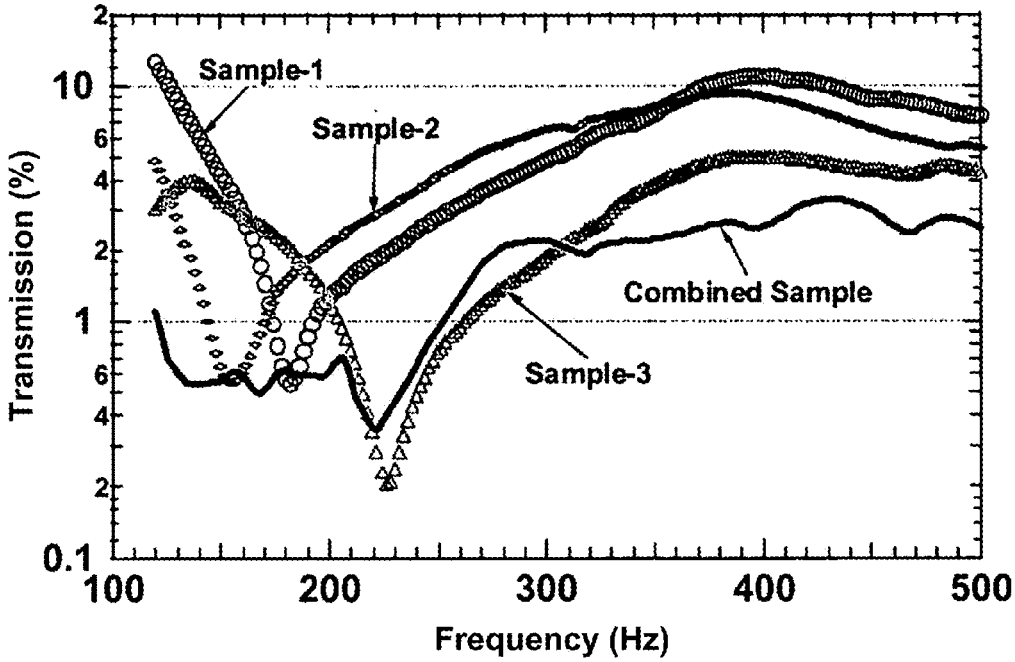
FIG. 5 is a graphic diagram showing the transmission spectra of three individual LRSM panels and that for a panel comprising the three LRSM panels stacked together.

FIG. 5 shows the amplitude transmission (t in Eq. (4) in the appendix below) spectra of Samples 1 to 3 and also a panel that is formed of Samples 1, 2 and 3 stacked together to form a combined panel. A single transmission dip is seen for each Example when they were measured individually. Sample 1 shows a transmission dip at 180 Hz, Sample 2 a dip at 155 Hz, and Sample 3 a dip at 230 Hz. The transmission dip shifts to lower frequencies with increasing mass of the screw/nut, following the predicted $$\sqrt{\frac{1}{m}}$$

relation. The curve of the measured transmission of the combined panel formed when the three samples were stacked together shows that together they form a broadband low transmission sound bather. Between 120 and 250 Hz the transmission is below 1%, which implies transmission attenuation of over 40 dB. Over the entire 120 to 500 Hz the transmission is below 3%, which implies transmission attenuation of over 35 dB.

Figure 6:
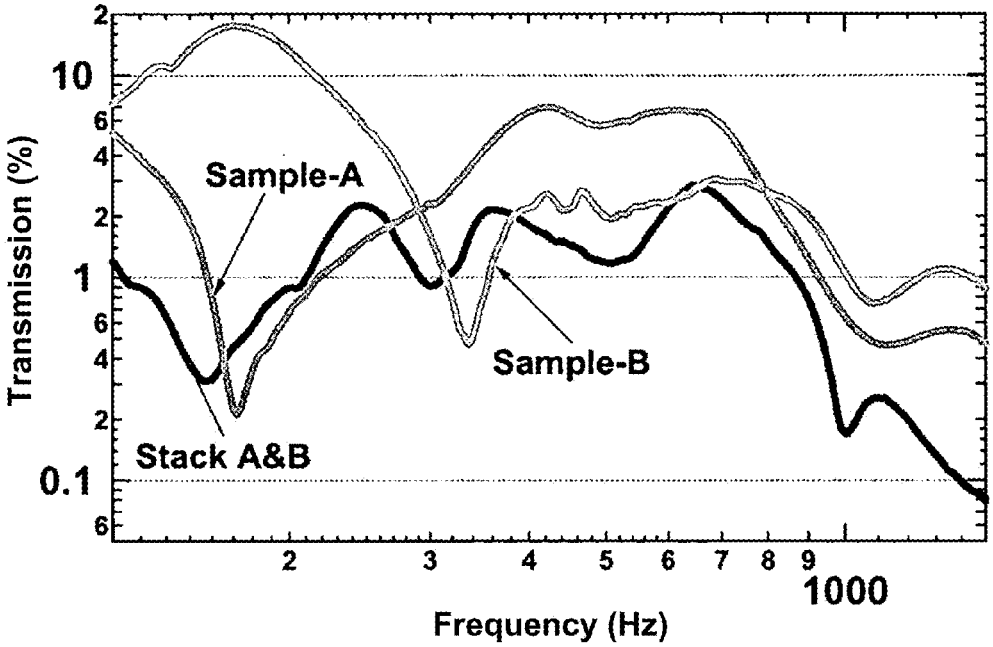
FIG. 6 is a graphic diagram showing the transmission spectra of two individual LRSM panels and a panel comprising the two LRSM panels stacked together.

For sound insulation at higher frequencies platelets having lighter weight are used as in Sample 4. FIG. 6 shows the transmission spectra of Samples 1 and 4, measured separately, and the spectrum when the two were stacked together. Again, the stacked sample exhibits the broad frequency transmission attenuation (from .about. 120 Hz to 400 Hz) not achieved in each of the single panels on their own.

To compare these results with the traditional sonic transmission attenuation techniques, it is possible to use the so-called mass density law of sound transmission (in air) through a solid panel with mass density ρ and thickness d: $t\alpha(f\ d\ \rho)^{-1}$. At .about 500 Hz, it is comparable to a solid panel with more than one order of magnitude heavier in weight, not to mention even lower frequencies.

Figure 7:
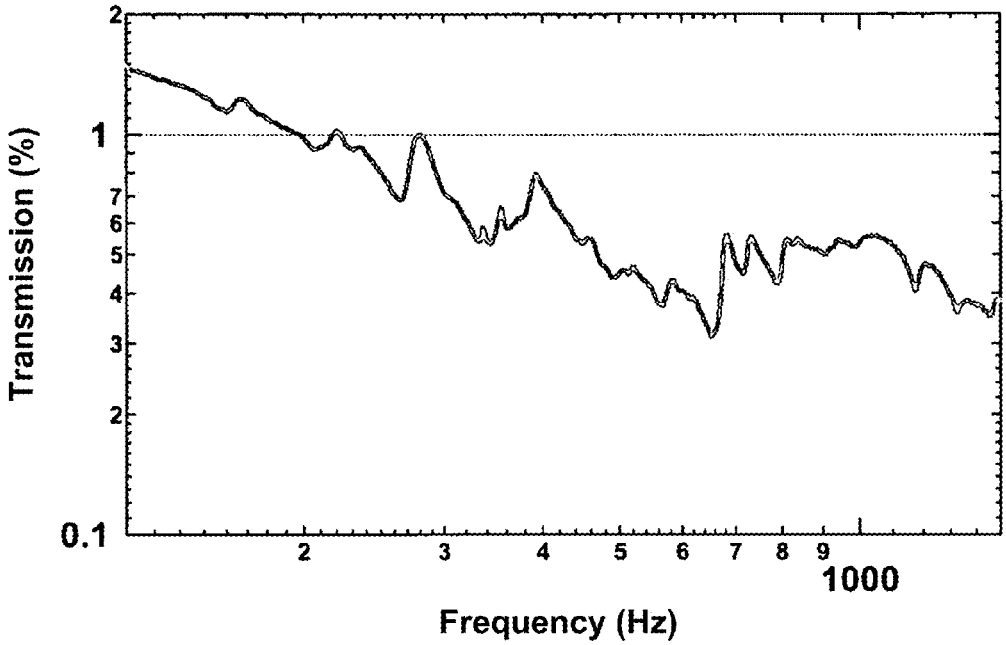
FIG. 7 is a graphic diagram showing the transmission spectrum of a solid panel for comparison.

FIG. 7 shows the transmission spectrum of a solid panel sample which is 4 cm thick with an area mass density of 33 $lb/ft^2$. The panel is made from bricks of "rubber soil". The general trend of the transmission is that it increases with lower frequency, just as predicted by the mass density law. The fluctuation is due to the internal vibration of the panel, which is not completely rigid.

Figure 8:
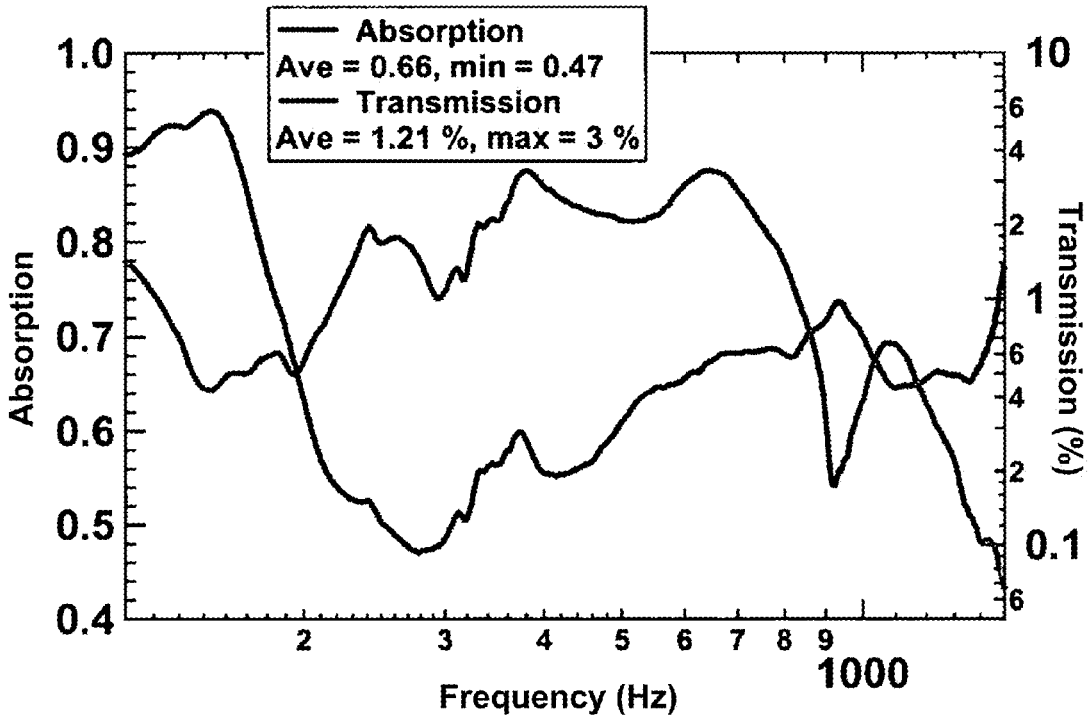
FIG. 8 is a graphic diagram showing the results of a high absorption and low transmission panel

The above-described LRSM panels all exhibit reflection near 90%, and a low reflection panel may be added to reduce the reflection or increase the absorption. FIG. 8 shows the absorption (left-hand axis) (=1−r*r−t*t), where r is the reflection coefficient and t the transmission coefficient (right-hand axis), of the stacked panel (consisting of the Samples 1 and 4 in FIG. 6 and the low reflection panel) to be 66% averaged over the 120 Hz to 1500 Hz range. In this case the low reflection panel is a combination of a holed plate which is a metal with tapered holes ranging in diameter from 1 mm to 0.2 mm, at a density of 10 holes per $cm^2$, followed by a layer of fiberglass. The transmission amplitude is below 3% at all frequencies, and the average value is 1.21%, or 38 dB over the 120 to 1500 Hz range. The total aerial weight of the combined panel is about 4.5 $lb/ft^2$, or 22 $kg/M^2$. This is lighter than a typical ceramic tile. The total thickness is less than 3 cm.

Compared with previous designs, this new design has the following advantages: (1) the sonic panels can be very thin; (2) the sonic panels can be very light (low in density); (3) the panels can be stacked together to form a broad-frequency LRSM material which can break the mass density law over a broad frequency range, and in particular can effectively break the mass density law for frequencies below 500 Hz; and, (4) the panels can be fabricated easily and at low cost.

The LRSM is inherently a reflecting material. By itself, the LRSM has very low absorption. Hence in applications where low reflection is also desired, the LRSM may be combined with other sound absorbing materials, in particular a combined LRSM-absorption panel can act as a low-transmission, low-reflection sound panel over the frequency range of 120-1000 Hz. Usually at frequencies over 1000 Hz, the sound can be easily attenuated, and no special arrangement would be needed. Thus in essence the present sonic panels can solve the sound attenuation problems in both indoor and outdoor applications, over a very wide frequency range.

For indoor applications, for example in wood-frame houses where the walls are fabricated using wood frames with gypsum boards, LRSM panels can be inserted between the gypsum boards, to achieve superior sound insulation between rooms by adding more than 35 dB of transmission loss to the existing walls. For outdoor applications, the panels can also be used as inserts inside the concrete or other weather-proofing frames, and to shield environmental noise, especially in low frequency ranges.

Rigid Plate Having an Asymmetric Shape

One advantage can be had by forming the metamaterials by using solid platelets having asymmetrical shapes. It should be noted that the membrane-type metamaterials described herein subject matter differ from configurations that were based on a different mechanism of anti-resonance occurring at a frequency that is in-between two eigenfrequencies, at which the structure is decoupled from the acoustic wave (and which also coincides with the diverging dynamic mass density), thereby giving rise to its strong reflection characteristic. Without coupling, there is naturally almost no absorption at the anti-resonance frequency. But even at the resonant eigenmode frequencies where the coupling is strong, the measured absorption is still low, owing to the strong coupling to the radiation mode that leads to high transmission. In contrast, for the dark acoustic metamaterials the high energy density regions couple minimally with the radiation modes, thereby leading to near-total absorption as in an open cavity.

In this arrangement, anti-resonances do not play any significant roles. The anti-resonances are essential in sound blocking, but are insignificant in sound absorption.

In one configuration, an LRSM design is mechanically configured as an array of local oscillators. Each local oscillator can be regarded as composed of two components: the mass m of the oscillator, and the spring K of the oscillator. In order to avoid increasing the overall weight of the panels, a lower K is chosen; however, a lower K is usually associated with soft materials, which would be difficult to sustain structurally. For this reason, a lower K is achieved through geometric means.

Figure 9:
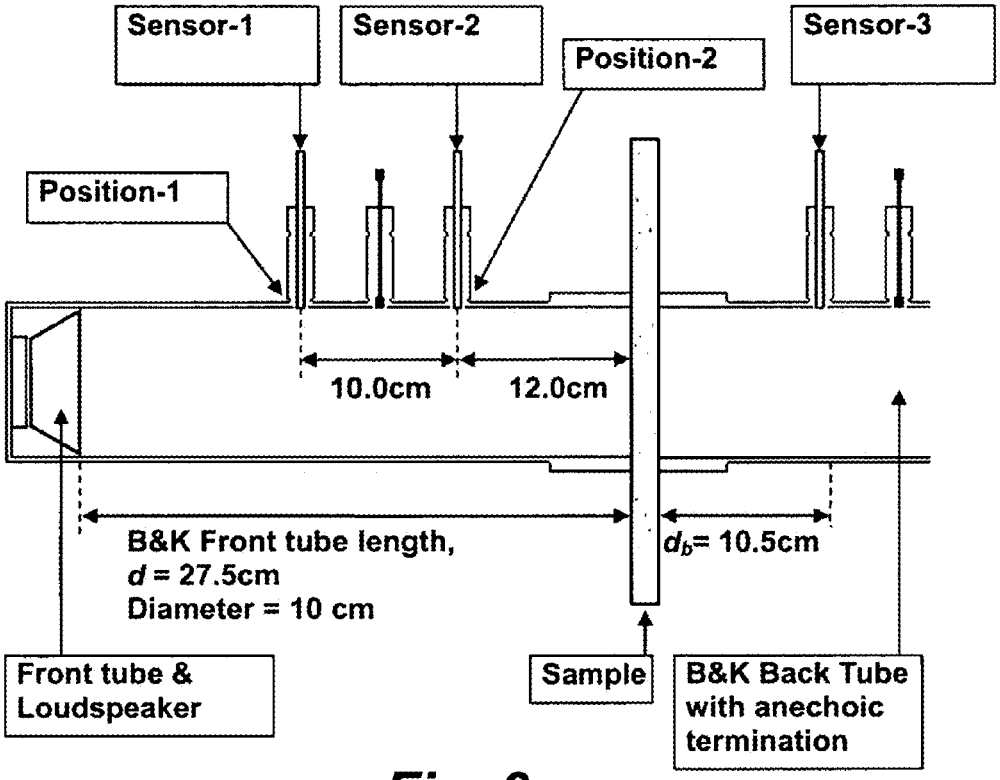
FIG. 9 illustrates schematically the measurement apparatus used to obtain the results of FIGS. 5 to 8.
Figure 10:
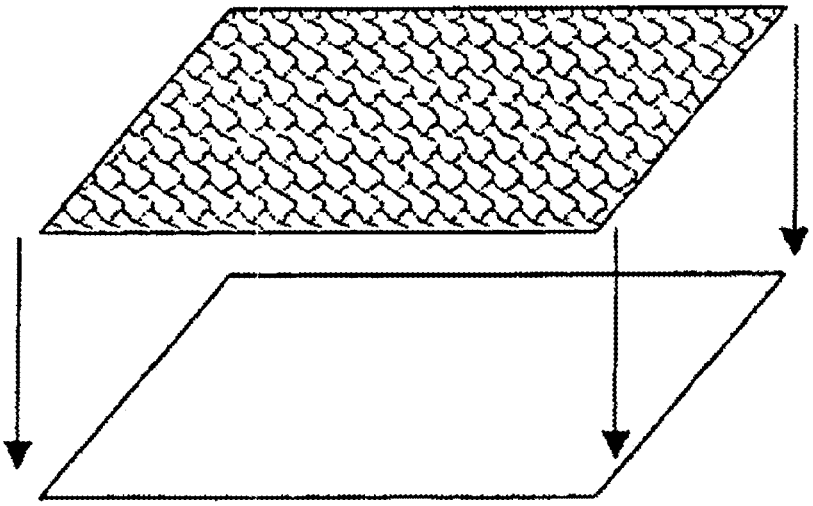
FIG. 10 illustrates an LSRM panel in combination with a second absorption panel.

FIG. 9 illustrates schematically the measurement apparatus used to obtain the results of FIGS. 5 to 8. FIG. 10 illustrates an LSRM panel in combination with a second absorption panel.

Examples

Figure 11A:
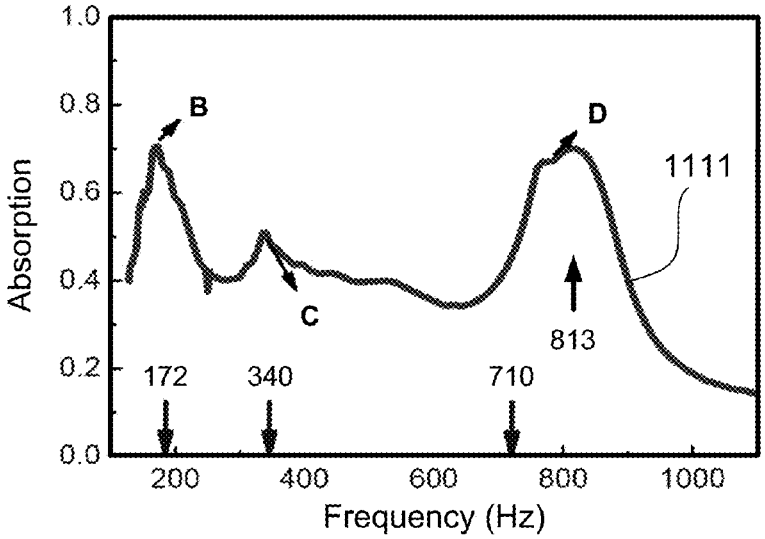
FIGS. 11A-11E are graphical depictions of properties of a sample unit cell and a photographic image of the sample unit cell.
Figure 11B:
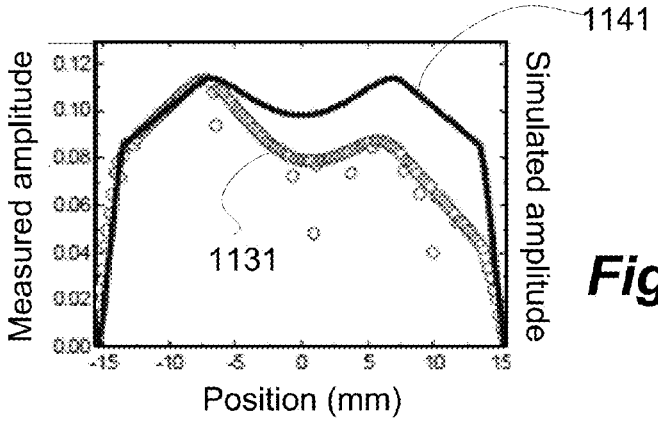

FIG. 11A is a graphical depiction of absorption properties of a unit cell as shown in FIG. 11B. In FIG. 11A, curve 111 denotes the measured absorption coefficient for Sample 5. There are three absorption peaks located at 172, 340, and 813 Hz, indicated by the arrows at the abscissa along the bottom of the graph. The arrows at 172, 340, and 710 Hz indicate the positions of the absorption peak frequencies predicted by finite-element simulations. The 813 Hz peak is the observed peak position obtained from experimental measurement appearing on curve 111 at "D". The arrow at 710 Hz indicates the theoretical peak position obtained by numerical calculation. Ideally the two values 710 Hz and 813 Hz should be the same, so the discrepancy indicates that the theoretical calculation is not an entirely accurate predictor of Sample 5 due to physical characteristics of the sample being modeled.

The unit cell of FIG. 11A comprises a rectangular elastic membrane that is 31 mm by 15 mm and 0.2 mm thick. The elastic membrane was fixed by a relatively rigid grid, decorated with or affixed with two semi-circular iron platelets with a radius of 6 mm and 1 mm in thickness. The iron platelets are purposely made to be asymmetrical so as to induce "flapping" motion, as seen below. This results in a relatively rigid grid that can be regarded as an enclosed planar frame within the order of tens of centimeters to tens of meters. Moreover, the iron platelets can be replaced with any other rigid or semi-rigid plates with asymmetric shapes. The sample with this configuration is denoted Sample 5, which in FIG. 11A is depicted in the xy plane, with the two platelets separated along the y-axis. Acoustic waves are incident along the z direction. This simple cell is used to understand the relevant mechanism and to compare with theoretical predictions.

Figure 11C:
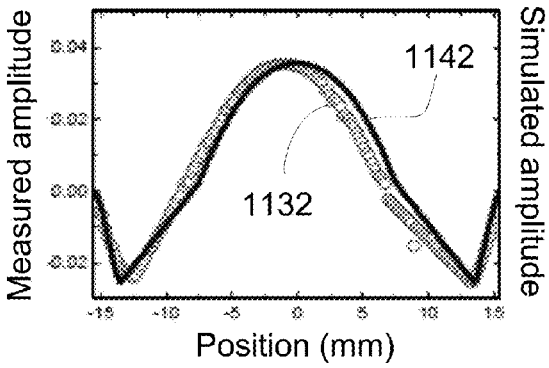
Figure 11D:
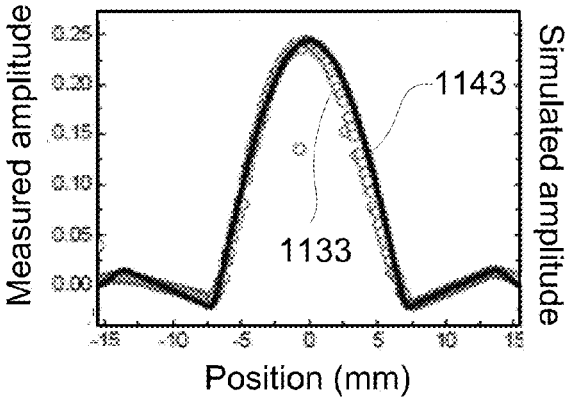
Figure 11E:
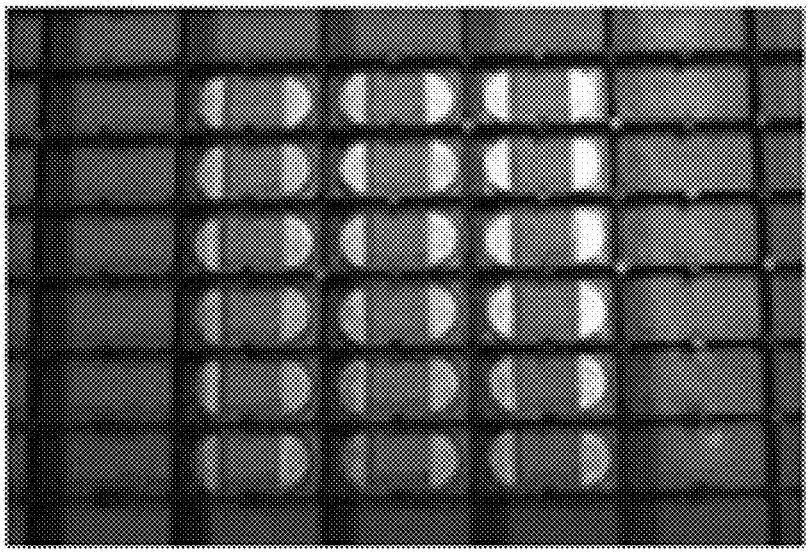

Three cross-sectional profiles, representing vibrational patterns across the structure, are depicted in FIGS. 11B, 11C and 11D. The cross-sectional profiles are taken in along a central line, at graph locations B, C and D of FIG. 11A, respectively. The cross-sectional profiles depicted in FIGS. 11B, 11C and 11D are of w along the x-axis of the unit cell. The straight sections (7.5 mm≤|x|≤13.5 mm) of the profile indicate the positions of the platelets, which may be regarded as rigid. The cross-sectional profiles depicted in FIGS. 11B, 11C and 11D show chains of circles 1131, 1132, 1133 denote the measured profile by laser vibrometer. Also shown in the insets are solid line curves 1141, 1142, 1143, which are the finite-element simulation results. A photo image of Sample 5 is shown in FIG. 11E.

Measured absorption as a function of frequency for Sample 5 is shown in FIG. 11A, where it can be seen that there are 3 absorption peaks around 172, 340, and 813 Hz. Perhaps the most surprising is the absorption peak at 172 Hz, at which more than 70% of the incident acoustic wave energy has been dissipated, a very high value by such a 200 μm membrane at such a low frequency, where the relevant wavelength in air is about 2 meters. FIG. 11A shows this phenomenon arising directly from the profiles of the membrane resonance.

The arrows in FIG. 11A at 172, 340, and 710 Hz indicate the calculated absorption peak frequencies. The Young's modulus and Poisson's ratio for the rubber membrane are $1.9\times10^6$ Pa and 0.48, respectively.

In experiments, the membrane is made of silicone rubber Silastic 3133. The Young's modulus and the Poisson's ratio of the membrane were measured.

Figure 12:
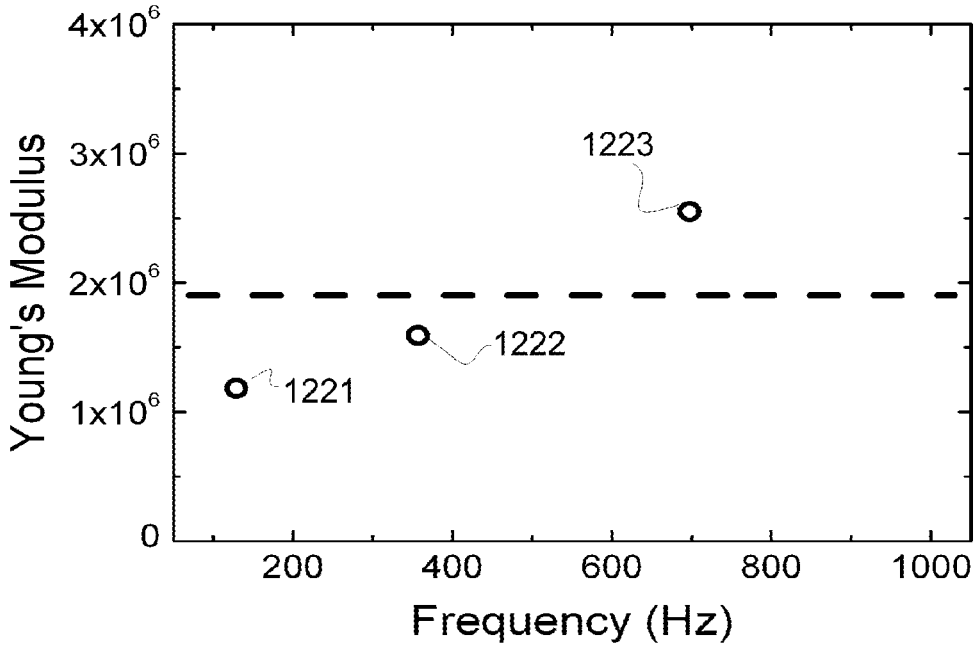
FIG. 12 is a diagram showing Young's modulus values.

FIG. 12 is a diagram showing Young's modulus values. Circles 1221, 1222, 1223 denote the Young's modulus E at several frequencies from experimental data. The dashed line denotes the average value $1.9\times10^6$ Pa which is the mean value within the relevant frequency range.

The measurement was performed in the "ASTM E-756 sandwich beam" configuration, where the dynamic mechanical properties of the membrane were obtained from the measured difference between the steel base beam (without membrane) properties and the properties of the assembled sandwich beam test article (with the membrane sandwiched in the core of the beam). In the measurement, the shear modulus (μ) data of the membrane at several discrete frequencies could be obtained. The Poisson ratio (ν) of the membrane was found to be around 0.48. Therefore, according to the relation between different elastic parameters, $E=2\mu(1+\nu)$,(0.1)

The Young's modulus (E) is obtained at those discrete frequencies, shown as circles 1221, 1222, 1223 in FIG. 12. For the sample material the measured E varies from $1.2\times10^6$ Pa to $2.6\times10^6$ Pa within the relevant frequency range. A frequency-independent value of the Young's modulus $E=1.9\times10^6$ Pa (shown as the dashed line in FIG. 12) was chosen so as to simplify the model.

The imaginary part of the Young's modulus is taken to be in the form $Im(E)=\omega.chi._0$, with the value $x_0=7.96\times10^2$ Pas obtained by fitting to the absorption. Many eigenmodes are found in the simulations. Out of these, the ones that are left-right symmetric are selected since the non-symmetric ones will not couple to the normally incident plane wave. The resulting absorption peak frequencies are located at 172, 340, and 710 Hz, respectively (indicated by the arrows in FIG. 11A). They are seen to agree very well with the observed peak frequencies.

The insets of FIG. 11A show the cross-sectional profile of the z-displacement w along the x-axis, within the unit cell for the three absorption peak frequencies. The circles denote the experimental measured data by laser vibrometer, while the solid curves are the finite-element simulation results. Excellent agreement is seen. But the most prominent feature of the profiles is that while the z-displacement w is continuous at the perimeters of the platelets (whose positions are indicated by the straight sections of the curves where the curvature is zero), there exists a sharp discontinuity in the first-order spatial derivative of w normal to the perimeter. For the low frequency resonance this discontinuity is caused by the "flapping" motion of the two semicircular platelets that is symmetric with respect to the y-axis; whereas the 712 Hz resonance is caused by the large vibration of the central membrane region, with the two platelets acting as "anchors".

The flapping motion results in a motion of the platelet that is not purely translational along z-axis (defined as out of membrane plane direction). A platelet undergoes flapping motion has different displacement (with respect to its balance position) at different parts. Physically, a flapping motion of the platelet can be viewed as a superposition of translational motion along z-axis, and rotational motion along an axis that is parallel to x-axis.

The characters of these modes also dictate the manner under which their resonance frequencies are tunable: Whereas for the flapping mode the frequency is shown to decrease roughly as the inverse square root of the platelet mass, the membrane vibration mode frequency can be increased or decreased by varying the distance of separation between the two semicircular platelets as depicted in FIG. 12. The intermediate frequency mode is also a flapping mode, but with the two ends of each wing in opposite phase. The asymmetric shape of the platelets enhances the flapping mode.

Another type of unit cell, denoted Sample 6, is 159 mm by 15 mm and comprises 8 identical platelets decorated or affixed symmetrically as two 4-platelet arrays (with 15 mm separation between the neighboring platelets) facing each other with a central gap of 32 mm. Sample 6 is used to attain near-unity absorption of the low frequency sound at multiple frequencies.

Figure 13:
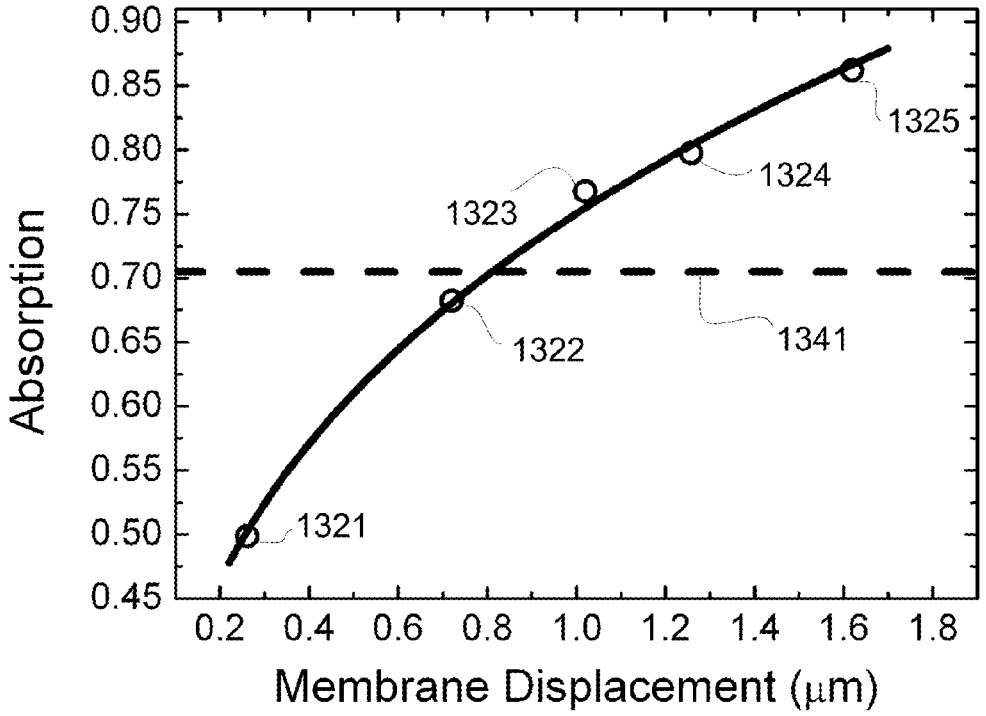
FIG. 13 is a diagram showing absorption vs. membrane displacement for a sample.

FIG. 13 is a diagram showing absorption vs. membrane displacement for Sample 6, showing the results of further tuning the impedance of the membrane by placing an aluminum reflector behind the membrane. The aluminum reflector can be placed various near-field distances behind the membrane in accordance with the desired acoustic effect. Circles 1321-1325 denote experimentally measured absorption coefficient and membrane displacement amplitude at 172 Hz when the distance between the membrane and the aluminum reflector was varied from 7 mm to 42 mm with 7 mm steps. Horizontal dashed line 1341 denotes the absorption level when the aluminum reflector is removed, that is, when the distance between the membrane and the aluminum reflector tends to infinity.

In FIG. 13, the absorption at 172 Hz is plotted as a function of the measured maximum normal displacement of the membrane for an incident wave with pressure modulation amplitude of 0.3 Pa. Circles 1321-1325 each indicate a distances of separation between the membrane and the reflector, varying from 7 mm to 42 mm in steps of 7 mm each. It is seen that adding an air cushion can enhance the absorption, up to 86% at a separation of 42 mm. That is roughly 2% of the wavelength. Moving the reflector further will eventually reduce the absorption to the value without the reflector, as indicated by dashed line 1341.

An explanation of the strong absorption can be found by considering the bending wave (or flexural wave) of a thin solid elastic membrane satisfying the biharmonic equation:

$$\nabla^4 w-(\rho h/D)\omega^2 w=0,$$

where $D=Eh^3/12(1-\nu^2)$ is the flexural rigidity and h the thickness of the membrane.

The corresponding elastic curvature energy per unit area is given by:

$$\Omega=\frac{1}{2}D\left[\left(\frac{\partial^2 w}{\partial x^2}\right)^2+\left(\frac{\partial^2 w}{\partial y^2}\right)^2+2\nu\frac{\partial^2 w}{\partial x^2}\frac{\partial^2 w}{\partial y^2}+2(1-\nu)+\left(\frac{\partial^2 w}{\partial x\partial y}\right)^2\right]$$

As Ω is a function of the second-order spatial derivatives of w, when the first-order derivative of w is discontinuous across the edge boundary, it is easy to infer that the areal energy density Ω should have a very large value within the perimeter region (divergent in the limit of a thin shell). Moreover, as the second derivative is quadratic, the integrated value of the total potential energy must also be very large. In the limit of small h, the vibration modes of the system may be regarded as a weak-form solution of the shell model, in the sense that while the biharmonic equation is not satisfied at the perimeter of the platelets (since the higher-order derivatives do not exist), yet besides this set of points with measure zero the solution is still a minimum case of the relevant Lagrangian.

Figure 14:
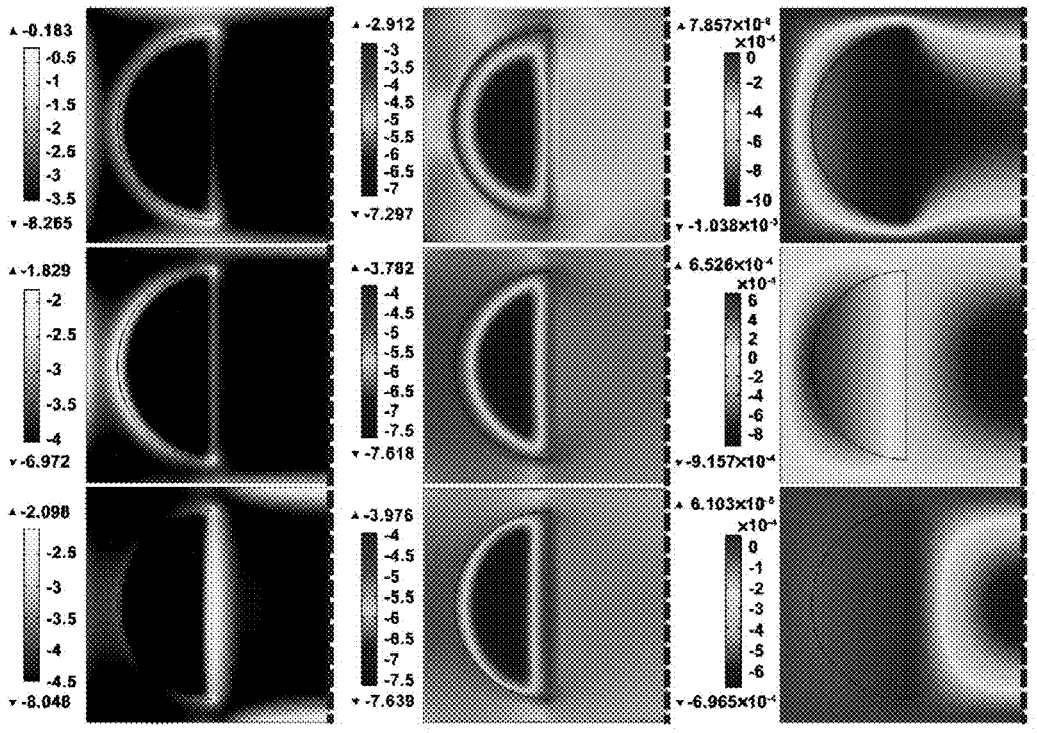
FIG. 14 is a sequence of diagrams showing calculated distributions of the elastic potential energy density (left column), trace of strain tensor (middle column), and displacement w within the xy plane (right column).

FIG. 14 is a sequence of diagrams showing calculated distributions of the elastic potential energy density (left column), trace of strain tensor $\epsilon=\epsilon_{xx}+\epsilon_{yy}+\epsilon_{zz}$ (middle column), and displacement w (right column) within the xy plane. The behavior is the result of the motion of the platelet, which is not purely translational along z-axis. The platelet undergoes flapping motion, and therefore has different displacement with respect to its balance position at different parts. Physically, a flapping motion of the platelet can be viewed as a superposition of translational motion along z-axis, and rotational motion along an axis that is parallel to x-axis. The three rows, from top to bottom, are respectively for the 3 absorption peak frequencies--190 Hz, 346 Hz, and 712 Hz. The left and middle columns' colors bars indicate the relative magnitudes of the quantities in question, with the numbers shown to be the logarithms of the magnitudes, base 10. The right column's color bar is linear in its scale. Since these modes are symmetric with respect to the x coordinate, only the left half is plotted for better visibility. The straight dashed lines indicate the mirroring planes.

The predicted large value of Ω within the perimeter region is easily verified as shown in FIG. 14, where a plot is made of the elastic potential energy density U obtained from the COMSOL simulations (left column, where the color is assigned according to a logarithmic scale, base 10) and displacement w (right column) distribution within the xy plane (mid plane of the membrane) around 3 absorption peak frequencies, 190, 346, and 712 Hz (from top to bottom), respectively. The energy density in the perimeter region is seen to be larger than that in other regions by up to 4 orders of magnitudes. There are also high energy density regions at the upper and lower edges of the unit cell, where the membrane is clamped. In the simulations, the integrated energy density U within the perimeter region accounts for 98% (190 Hz), 87% (346 Hz), and 82% (712 Hz) of the total elastic energy in the whole system. As the local dissipation is proportional to the product of energy density with dissipation coefficient, the large multiplying effect implied by the huge energy density can mean very substantial absorption for the system as a whole. This fact is also reflected in the strain distribution around the three absorption peak frequencies, as shown in the middle column of FIG. 14. It is found that the strain in the perimeter region, on the order of $10^{-3}$-$10^{-4}$, is much larger than that in the other parts of the membrane by at least 1-2 orders of magnitude.

In a conventional open system, high energy density is equally likely to be radiated, via transmitted and reflected waves, as to be absorbed. It is noted that in the present case, the small volumes in which the elastic energy is concentrated may be regarded as an "open cavity" in which the lateral confinement in the plane of the membrane is supplemented by the confinement in the normal direction, owing to the fact that the relative motion between the platelets and the membrane contributes only minimally to the average normal displacement of the membrane. Hence from the dispersion relation $k_{\|}^2 k_{\perp}^2 = k_o^2 = (2\pi\lambda)^2$ for the waves in air, where the subscripts ‖ and ⊥ denote the component of the wave vector being parallel (perpendicular) to the membrane plane, it can be seen that the relative motions between the platelets and the membrane, which must be on a scale smaller than the sample size $d \ll \lambda$, can only couple to the evanescent waves since the relevant $k_{\|}^2 \gg k_o^2$. Only the average normal displacement of the membrane, corresponding to the piston-like motion, would have $k_{\|}$ components that are peaked at zero and hence can radiate. But the high energy density regions, owing to their small lateral dimensions, contribute minimally to the average component of the normal displacement.

In accordance with the Poynting's theorem for elastic waves, the dissipated power within the membrane can be calculated as:

$$Q = 2\omega^2(\chi_0/E)\int U dV$$

Absorption is defined as Q/(Ps), where $P = p^2/(\rho c)$ denotes the Poynting's vector for the incident acoustic wave and S is membrane's area, with p being the pressure amplitude. With the previously given parameter values, the absorption at the three resonant frequencies (in the order of increasing frequency) is calculated to be 60%, 29%, and 43%, respectively. It is noted that the calculated values reproduces the relative pattern of the three absorption peaks, although they are smaller than the experimental values by ~10-20%. This discrepancy is attributed to the imperfection in the symmetry of the sample, whereby a multitude of asymmetric vibrational eigenfunctions can be excited by the normally incident plane wave. Together with the width of these modes, they can effectively contribute to a level of background absorption not accounted for in the simulations.

It should be noted that the present membrane-type metamaterials differ from the previous approaches that were based on the different mechanism of anti-resonance occurring at a frequency that is in-between two eigenfrequencies, at which the structure is decoupled from the acoustic wave (and which also coincides with the diverging dynamic mass density), thereby giving rise to its strong reflection characteristic. Without coupling, there is naturally almost no absorption at the anti-resonance frequency. But even at the resonant eigenmode frequencies where the coupling is strong, the measured absorption is still low, owing to the strong coupling to the radiation mode that leads to high transmission. In contrast, for the dark acoustic metamaterials the high energy density regions couple minimally with the radiation modes, thereby leading to near-total absorption as in an open cavity.

Figure 15A:
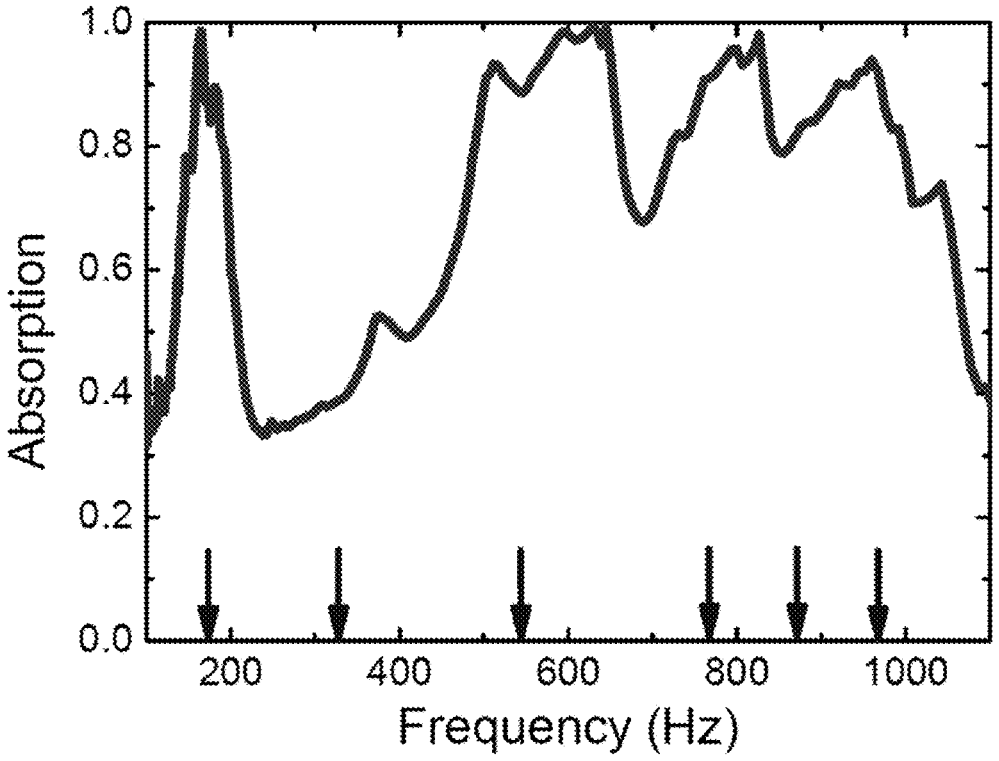
FIGS. 15A and 15B are depictions of an absorption coefficient and photographic image of a 2 layer sample.
Figure 15B:
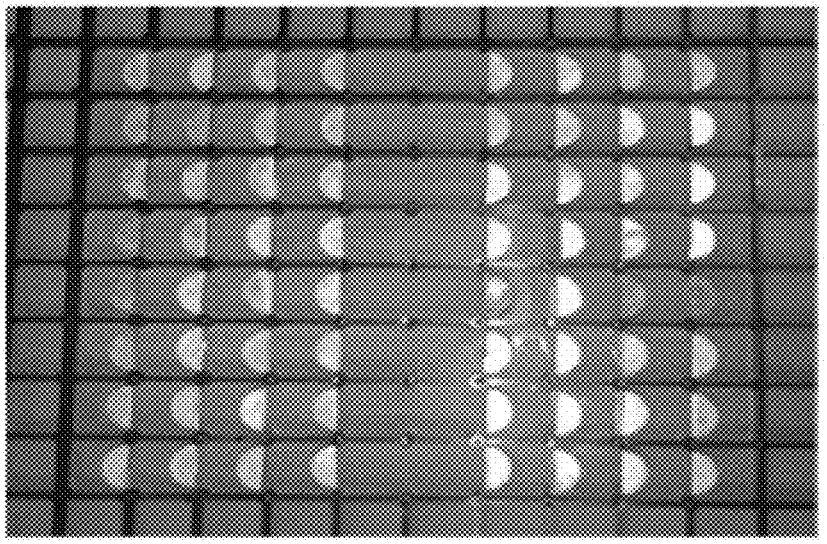

FIG. 15A shows the measured absorption coefficient for 2 layers of Sample 6. A photo image of the array is shown in FIG. 15B. In the measurements, the impedance of the system is tuned by placing an aluminum reflector 28 mm behind the second layer. The distance between the first and second layers was also 28 mm. It can be seen that there are many absorption peaks around 164, 376, 511, 645, 827, and 960 Hz. The absorption peaks at 164 Hz and 645 Hz are seen to be ~99%. By using COMSOL, the absorption peak frequencies for a single layer of Sample 6 are also calculated. They are located around 170, 321, 546, 771, 872, and 969 Hz, respectively. These are indicated by the arrows in FIG. 13. Reasonably good agreement with the experimental values is seen, with no adjustable parameters.

The curve indicates the experimentally measured absorption coefficient for 2 layers of Sample 6. An aluminum reflector was placed 28 mm behind the second layer. The distance between the first and second layers is also 28 mm. Referring to FIG. 15A, the absorption peaks are located around 164, 376, 511, 645, 827, and 960 Hz, respectively. The arrows indicate the positions of the absorption peak frequencies predicted by finite-element simulations. Good agreement is seen.

Figure 16A:
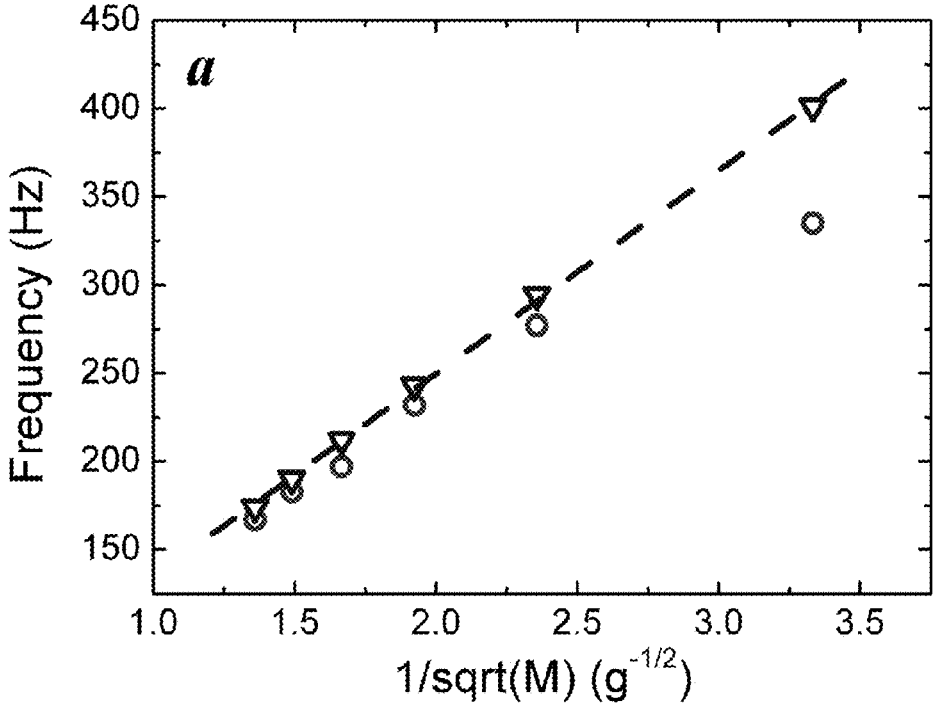
FIGS. 16A and 16B are diagrams showing absorption peaks as an inverse square of mass, at 172 Hz (FIG. 16A) and 813 Hz (FIG. 16*b*).
Figure 16B:
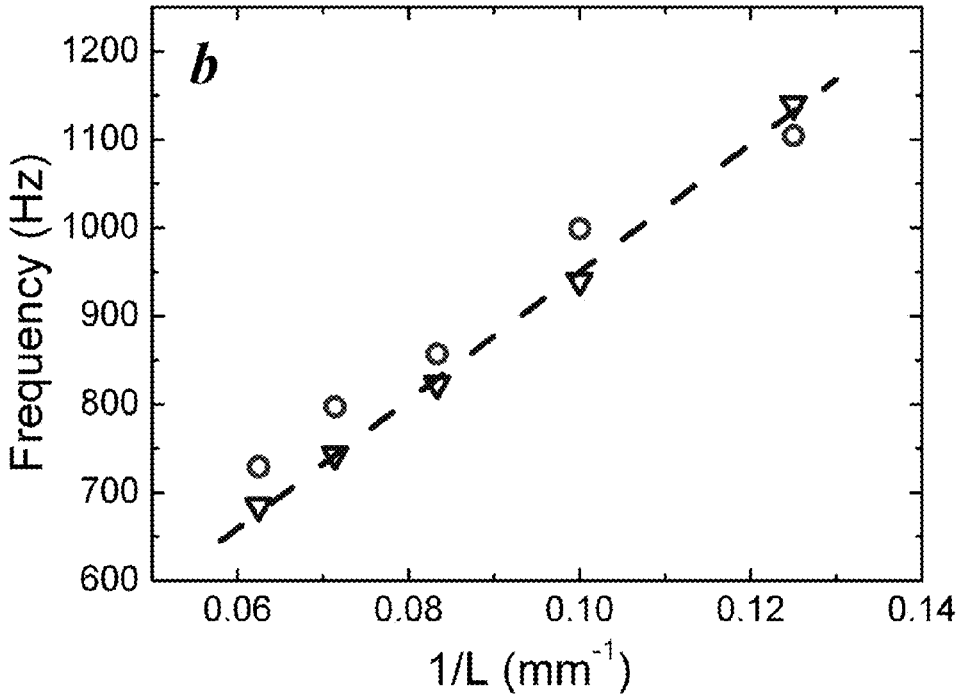

FIGS. 16A and 16B are diagrams showing absorption peaks as an inverse square of mass, at 172 Hz (FIG. 16A) and 813 Hz (FIG. 16*b*). In FIG. 16A, it is seen that the 172 Hz absorption peak moves to higher frequencies as the inverse of the square root of each platelet's mass M. In FIG. 16B, the 813 Hz peak is seen to vary as the inverse separation L between the two platelets. Here the circles denote experimental data, and triangles the simulation results.

Eigenmode Frequencies

To contrast with the previous membrane-type metamaterials that exhibit near-total reflection at an anti-resonance frequency, the mechanism of such metamaterials as well as present their measured absorption performance will be described.

Figure 17A:
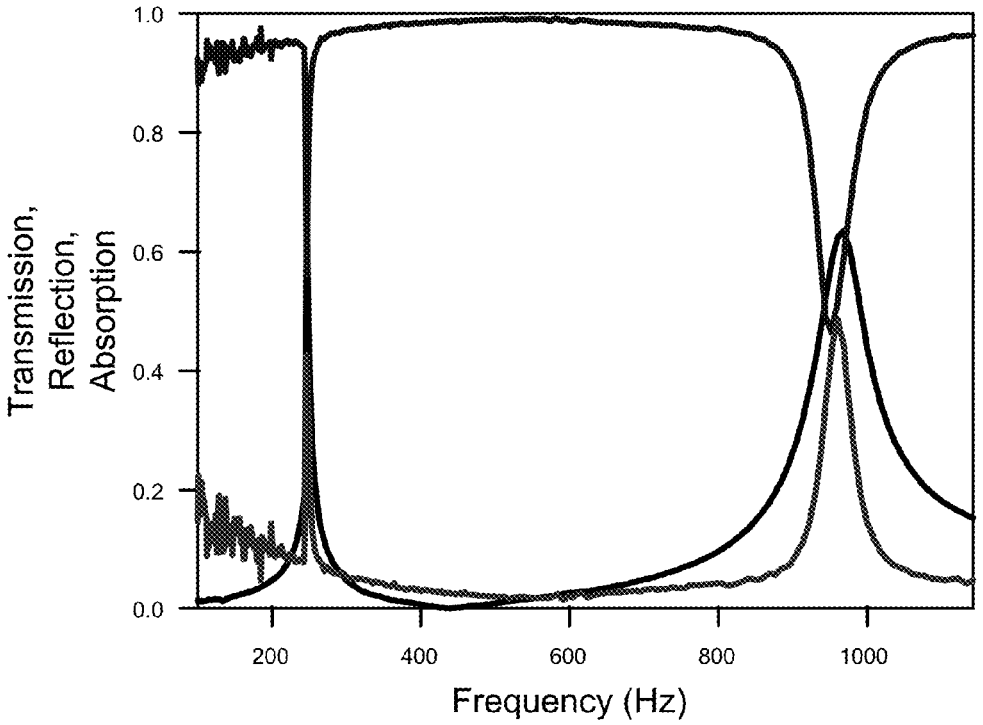
FIGS. 17A and 17B are diagrams showing absorption for a one-layer membrane (FIG. 17A) and a five layer membrane (FIG. 17A).
Figure 17B:
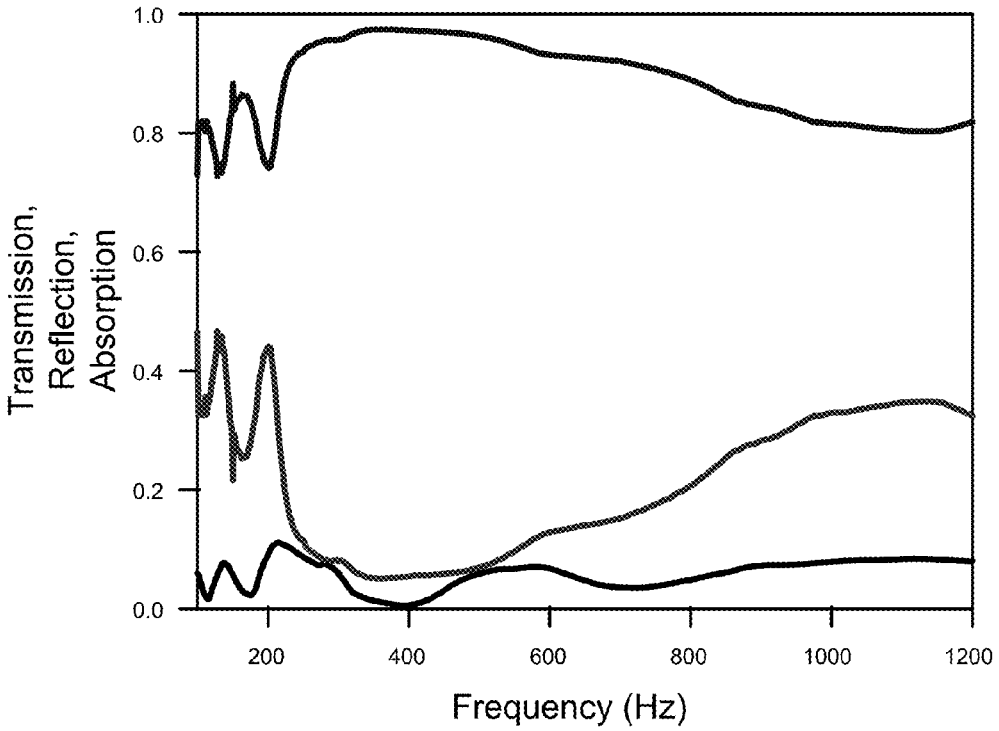

FIGS. 17A and 17B are diagrams showing absorption for a one-layer membrane (FIG. 17A) and a five layer membrane (FIG. 17B). (a) Amplitudes of transmission (dashed curve at top of the graphs in both figures), reflection dotted curve and absorption solid curve) for the one-layer membrane-type metamaterial reflector Strong reflection of sound can occur at a frequency in-between two neighboring resonant (eigenmode) frequencies. In contrast, at the resonant eigenmode frequency the excitation of the eigenmodes can lead to transmission peaks, at the anti-resonance frequency the out-of-phase hybridization of two nearby eigenmodes leads to a near-total decoupling of the membrane structure from the radiation modes. This turns out to also coincide with a divergent resonance-like behavior of the dynamic mass density. Near-total reflection of the acoustic wave is thereby the consequence at the anti-resonance frequency. Since the structure is completely decoupled from the acoustic wave at the anti-resonance frequency, the absorption is naturally very low as shown in FIG. 17A at around 450 Hz. But even at the resonant eigenfrequencies, it is noted that the absorption coefficient for this type of metamaterial is still low, barely reaching 45% at the relatively high frequency of 1025 Hz, which is significantly less that that achieved with the dark acoustic metamaterials. This is attributed to the relatively strong coupling to the radiation modes caused by the piston-like motion of membrane that can lead to high transmission (0.88 at 260 Hz, 0.63 at 1025 Hz).

Even for a five-layer Sample 2, the averaged absorption coefficient is a mere 0.22, with maximum value not surpassing 0.45, as shown in FIG. 17B. It is noted that besides the large number of membrane layers, this sample was also sandwiched by two soft panels with holes, with the expressed purpose of enhancing the absorption. Therefore even with these efforts this panel's absorption performance is still way below the dark acoustic metamaterials.

It has been demonstrated that the combined effect of very large curvature energy density at the perimeter of the platelets, in conjunction with its confinement effect, can be particularly effective for sub-wavelength low frequency acoustic absorption. Since the membrane system has also been shown to be effective in totally reflecting low frequency sound, together they can constitute a system of low frequency sound manipulation with broad potential applications. In particular, lowering the cabin noise in airliners and ships, tuning the acoustic quality of music halls, and environmental noise abatement along highways and railways are some promising examples.

Experimental Set-Up

Measurements of the absorption coefficients shown in FIGS. 11A-11D were conducted in a modified impedance tube apparatus comprising two Bruel & Kjær type-4206 impedance tubes with the sample sandwiched in between. The front tube has a loud speaker at one end to generate a plane wave. Two sensors were installed in the front tube to sense the incident and reflected waves, thereby obtaining both the reflection amplitude and phase. The third sensor in the back tube (which is terminated with an anechoic sponge) senses the transmitted wave, to obtain the transmission amplitude and phase. The anechoic sponge has a length of 25 cm, sufficient to ensure complete absorption of the transmitted wave behind the third sensor. The signals from the three sensors are sufficient to resolve the transmitted and reflected wave amplitudes, in conjunction with their phases. The absorption coefficient was evaluated as $A=1-R^2-T^2$, with R and T being the measured reflection and transmission coefficients, respectively. The absorption measurements were calibrated to be accurate by using materials of known dissipation.

The cross-sectional profiles of the z-direction displacement shown in the FIGS. 11B-11D were obtained by using the laser vibrometer (Type No. Graphtec AT500-05) to scan the Sample 5 along the x-axis, within the unit cell around the 3 absorption peak frequencies.

Theory and Simulations

The numerical simulation results shown in FIGS. 11A-11D, and in FIGS. 16A and 16B were prepared using "COMSOL MULTIPHYSICS", a finite-element analysis and solver software package. In the simulations, the edges of the rectangular membrane are fixed. An initial stress in the membrane, $\sigma_x^{initial}=\sigma_y^{initial}=2.2\times10^5$ Pa was used in the calculation as the tunable parameter to fit the data. The mass density, Young's modulus and Poisson's ratio for the rubber membrane are 980 kg/m$^3$, $1.9\times10^6$ Pa, and 0.48, respectively. The mass density, Young's modulus and Poisson's ratio for the iron platelets are 7870 kg/m$^3$, $2\times10^{11}$ Pa, and 0.30, respectively. Standard values for air, i.e., $\rho=1.29$ kg/m$^3$, ambient pressure of 1 atm, and speed of sound in air of c=340 m/s, were used. Radiation boundary conditions were used at the input and output planes of the air domains in the simulations.

Absorption at Oblique Incidence

The dark acoustic metamaterials, especially Sample 6, can exhibit many resonant eigenmodes. At normal incidence only those eigenmodes with left-right symmetry can be coupled to the incident wave. While imperfections in the sample can cause some coupling with the non-symmetric modes that may be responsible for the higher observed background absorption than that obtained by simulations, it would be interesting to use oblique incidence to purposely probe the consequence of exciting more modes in Sample 6.

Figure 18:
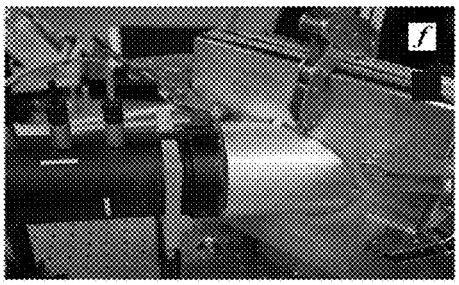
FIG. 18 is an image of an experimental setup for oblique incidence at 45°.
Figure 19A:
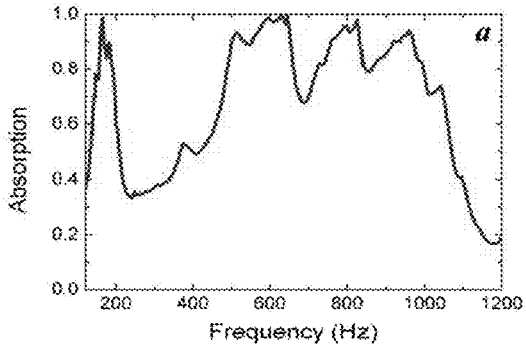
FIGS. 19A-19E are diagrams showing absorption coefficients measured for different incident angles: 0° (FIG. 19A), 15° (FIG. 19B), 30° (FIG. 19C), 45° (FIG. 19D), and 60° (FIG. 19E).
Figure 19B:
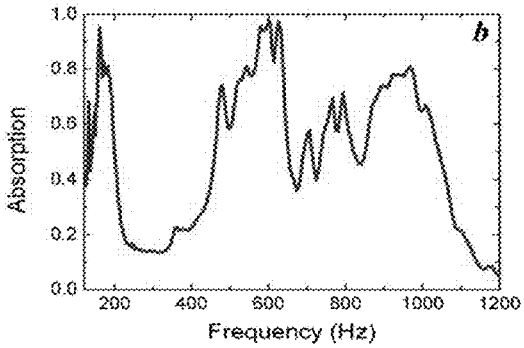
Figure 19C:
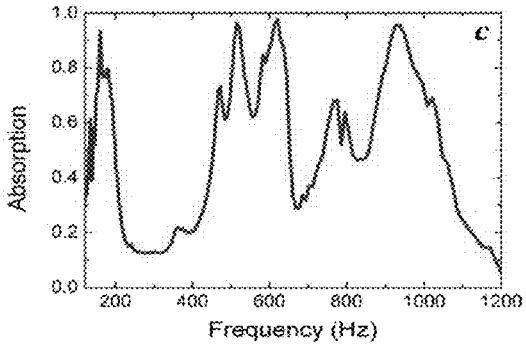
Figure 19D:
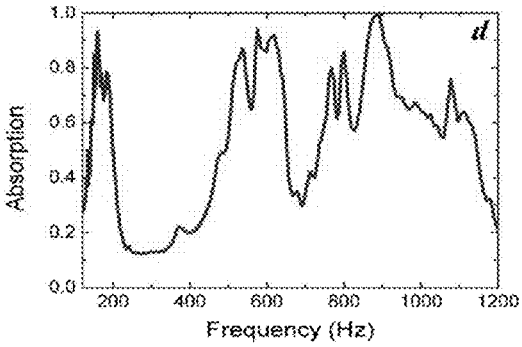
Figure 19E:
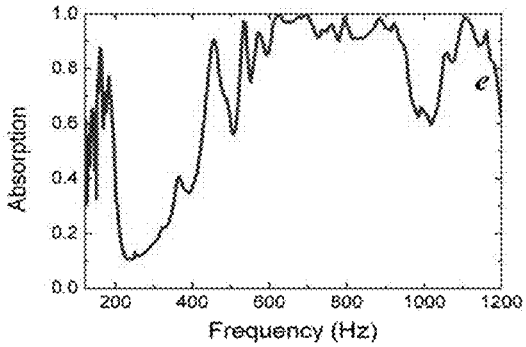

FIG. 18 is an image of an experimental setup for oblique incidence at 45°. This setup can be adjusted for different incident angles in order to test absorption, as depicted in FIGS. 19A-19E. FIG. 19 are diagrams showing absorption coefficients measured for different incident angles: 0° (FIG. 19A), 15° (FIG. 19B), 30° (FIG. 19C), 45° (FIG. 19D), and 60° (FIG. 19E).

Off-normal incidence measurements were carried out with Sample 6 for 4 oblique incident angles—15°, 30°, 45° and 60°. The experimental setup for oblique incidence is shown in FIG. 19F. The measured absorption coefficients for different angles are shown in FIG. 19A-19E. The results indicate qualitative similarity up to 60°, at which angle the frequency ranges of 650-950 Hz and 1000-1200 Hz exhibit a pronounced increase in absorption. This is attributed to the fact that large off-normal incident angle can excite many more resonant modes which were decoupled by the left-right symmetry under the condition of normal incidence.

Hence the acoustic metamaterials can actually perform like a limited broad-band, near-total absorber at oblique incidence.

As mentioned earlier, there are many eigenmodes in the system which are decoupled from the normally incident wave owing to its left-right symmetry. In order to explore the consequence when such symmetry is broken, measurements on Sample 6 were also carried out under oblique incidence. The measured results indicate qualitative similarity up to 60°, at which angle the frequency ranges of 650-950 Hz and 1000-1200 Hz exhibit a pronounced increase in absorption. Thus the overall performance of the dark acoustic metamaterials does not deteriorate under a broad range of incident angles but may even improve within certain frequency regimes.

Properties of Solid Membranes Having Central Platelets

Figure 20A:
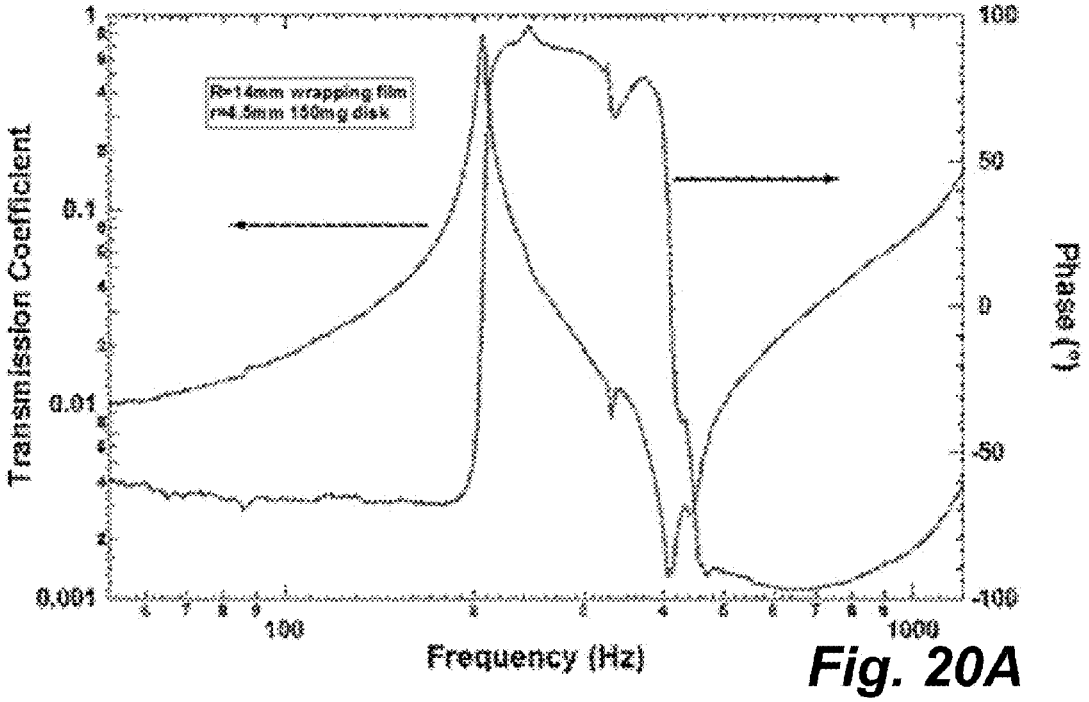
FIGS. 20A and 20B are graphic diagrams showing the two experimental transmission spectra using plastic wrap and aluminum foil as membranes.
Figure 20B:
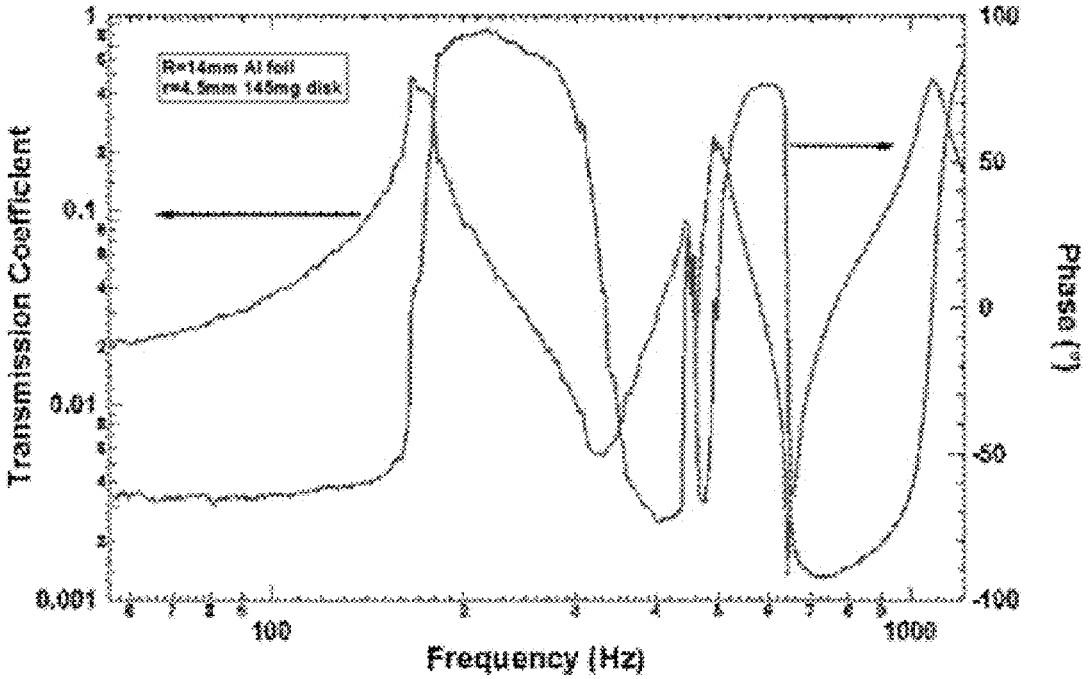

FIGS. 20A and 20B are graphic diagrams showing the two experimental transmission spectra using plastic wrap (FIG. 20A) and aluminum foil (FIG. 20B) as membranes. The diagrams show transmission amplitude (left axis) and phase (right axis) as a function of frequency for the membranes. The transmission amplitude (left axis) and phase (right axis) are associated with the curves according to the arrows on the diagrams. Both types of membranes are the type of materials frequently used for food packaging in home kitchens, with approximate thicknesses of 0.1 mm.

Both spectra exhibit typical transmission minimum anti-resonances between two transmission maximum resonances. The anti-resonance principle for the occurrence of transmission minimum works in structures containing membranes made of solids other than rubber. In addition, the thickness of the sheet of solid materials can be constructed to be fairly constant or can be constructed so that the thickness varies across the cell.

Figure 21A:
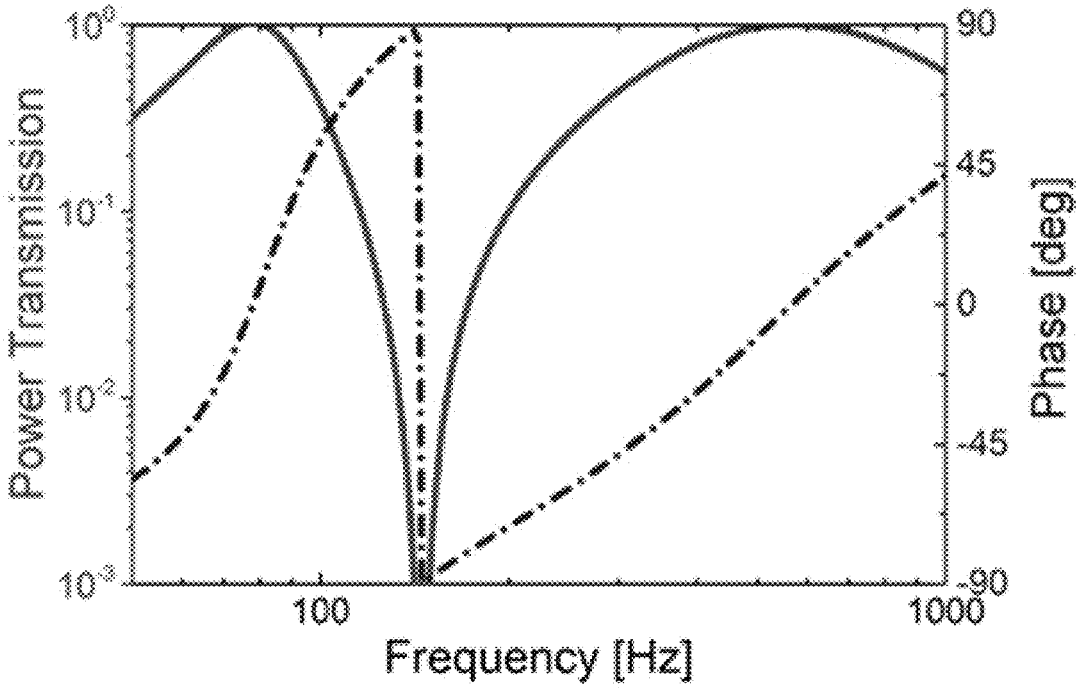
FIGS. 21A and 21B are graphical diagrams showing numerical simulation transmission spectra for the structures with Acrylonitrile Butadiene Styrene (ABS).
Figure 21B:
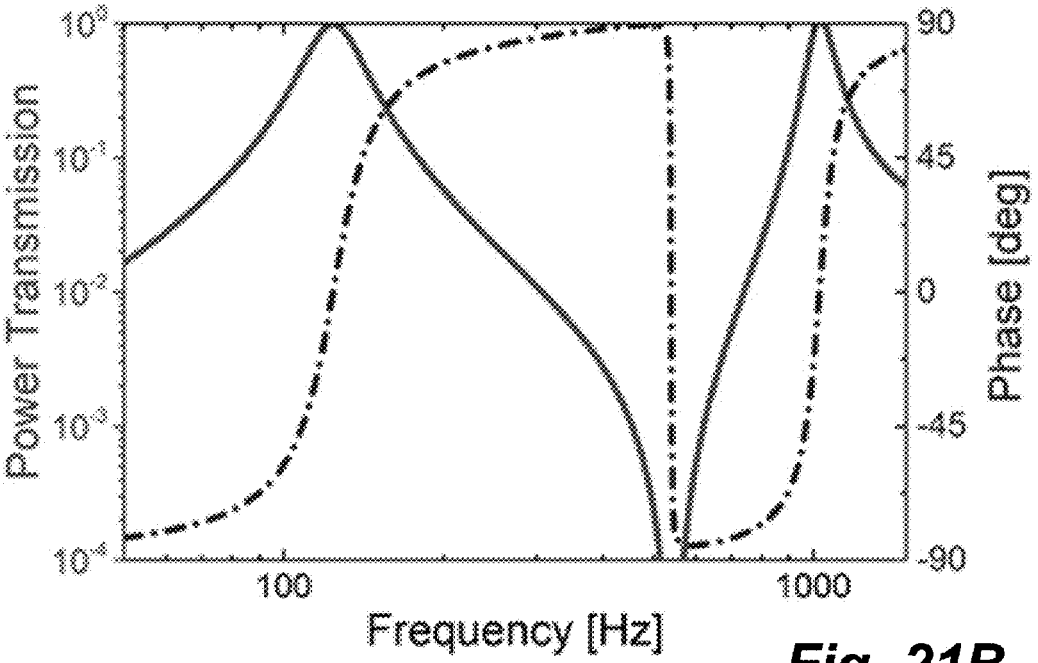
Figure 22:
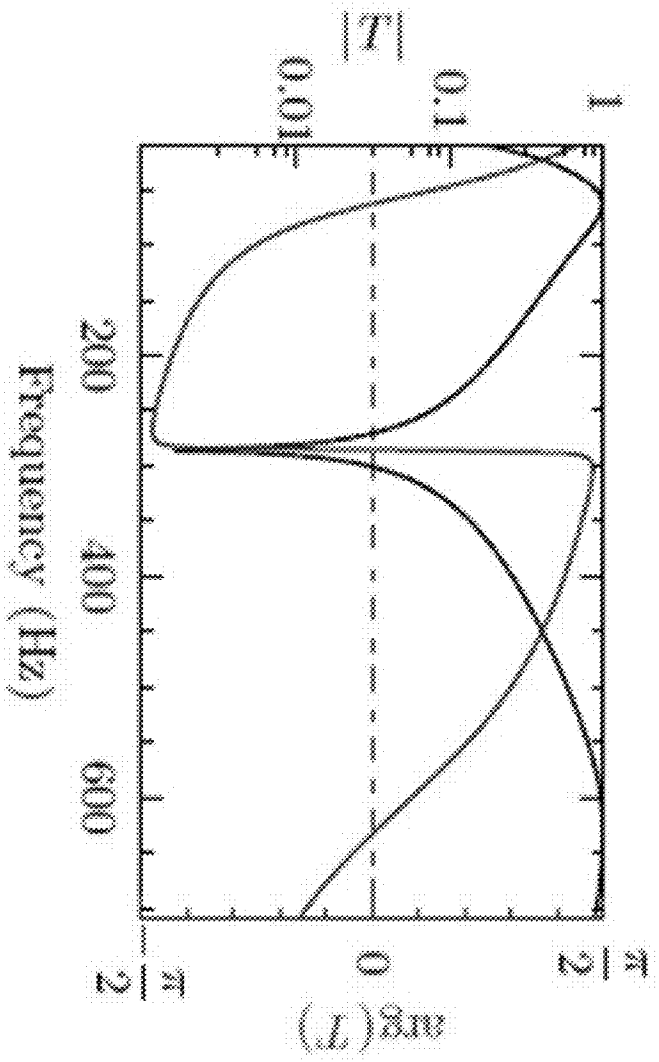
FIG. 22 is a graphical diagram shows numerical simulation transmission spectra for an aluminum membrane, with membrane radius=50 mm, thickness=0.1 mm, platelet radius=20 mm, thickness=0.1 mm.

FIGS. 21 and 22 are graphic diagrams showing numerical simulation transmission spectra for the structures with Acrylonitrile Butadiene Styrene (ABS), shown in FIGS. 21A and 21B membrane and for an aluminum membrane, shown in FIG. 22. FIG. 21A depicts numerical simulations of the structures with Acrylonitrile Butadiene Styrene (ABS) membrane, with ABS membrane radius=50 mm, thickness=0.1 mm, Pb platelet radius=8 mm, thickness=1.1 mm. FIG. 21B depicts numerical simulations of the structures with Acrylonitrile Butadiene Styrene (ABS) membrane with ABS membrane radius=100 mm, thickness=0.5 mm, ABS platelet radius=40 mm, thickness=2.25 mm. The solid trace represents power transmission and the dashed line trace represents phase. They are seen to agree well with the experimental results in FIG. 20.

FIG. 22 is a graphic diagram shows numerical simulation transmission spectra for an aluminum membrane, with membrane radius=50 mm, thickness=0.1 mm, platelet radius=20 mm, thickness=0.1 mm.

Figure 23A:
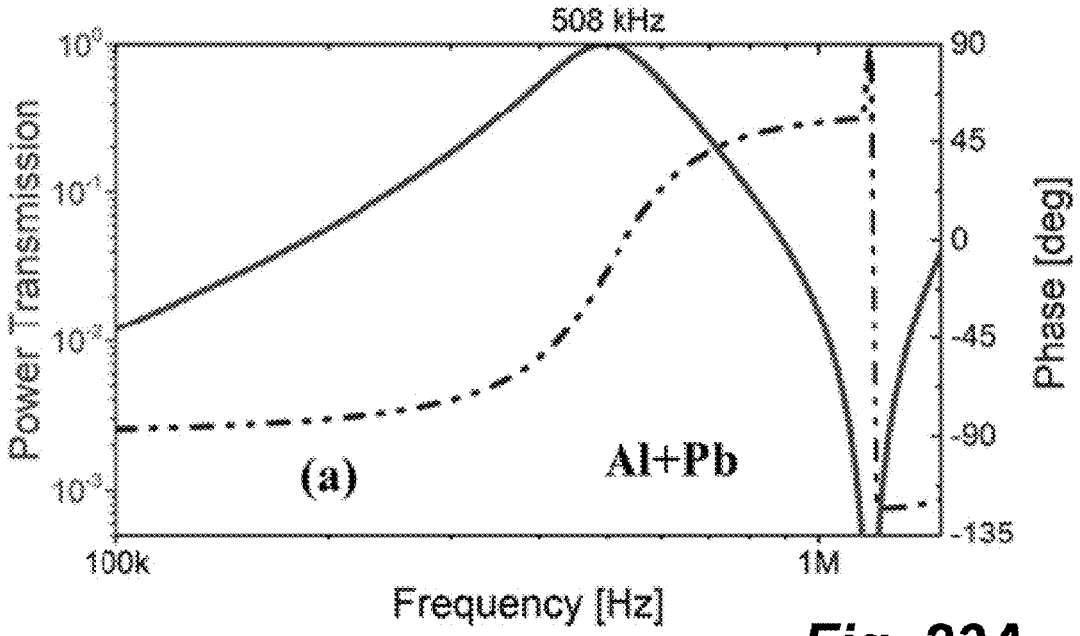
FIGS. 23A and 23B are graphical diagrams showing numerical simulations of structures with working frequencies in the ultrasound regime.
Figure 23B:
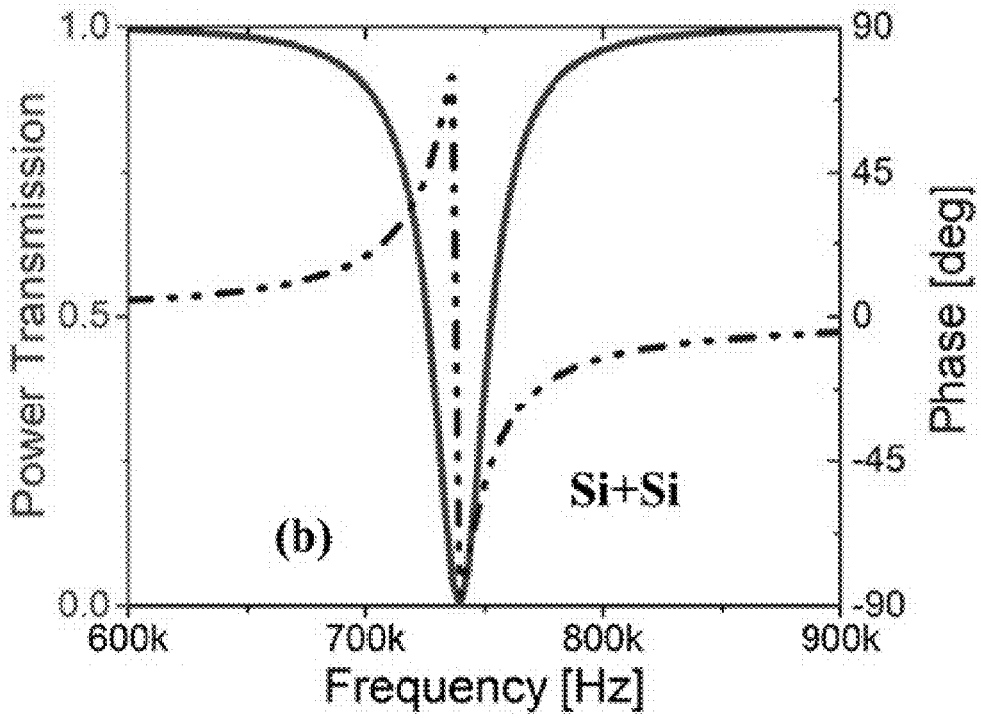

FIGS. 23A and 23B are graphical diagrams showing numerical simulations of structures with working frequencies in the ultrasound regime. FIG. 23A depicts numerical simulations of the structures with Al membrane radius=0.5 mm, thickness=0.1 mm, Pb platelet radius=0.15 mm, thickness=0.1 mm. FIG. 23B depicts numerical simulations of the structures with Si membrane radius=0.5 mm, thickness=0.1 mm, Si platelet radius=0.2 mm, thickness=0.3 mm.

As can be seen, the structures are able to have a working frequency in the ultrasound regime. It is clear that by adjusting the design parameters one can cover a wide frequency range.

Multiple and Alternating Cell Types

FIGS. 24A-24E are schematic diagrams showing arrangements in which multiple types of unit cells are provided, in which alternating arrangements in which different alternating arrangements of cell of one type (type-A) are adjacent cells of a second type (type-B). In each depicted such an arrangement, two or more types of unit cells are distributed alternatively or according to a predetermined pattern on the planar panel. At some particular frequency range, the vibration of cells of one type (type-A cells) is in opposite phase as the other type (B-type). Consequently, the sound waves emitted by type-A cells cancel that by those emitted by type-B cells via wave interference, so that the incident sound waves onto the panel are effectively blocked, resulting in a passive effect that is analogous to electronic Active Noise Reduction (ANR). Pushing the situation to a logical extreme, cells of one type can be completely empty. This can be configured in different ratios of type-A and type-B cells, as depicted in FIGS. 24B-24E.

Figure 24A:
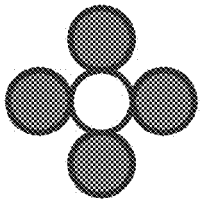
FIGS. 24A-24E are schematic diagrams showing arrangements in which multiple types of unit cells are provided.

FIG. 24A depicts an alternating arrangement in which a cell of one type (type-A) is adjacent cells of a second type (type-B). This can be configured in different ratios of type-A and type-B cells.

Figure 24B:
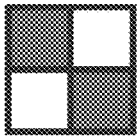

FIG. 24B depicts an arrangement in which the alternating arrangement is such that the closest cell of the same type (e.g., type-A to type-A or type-B to type-B) are more remote than the closest cell of the opposite type (e.g., type-A to type-B or vice-versa).

Figure 24C:
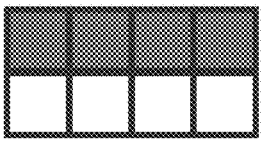

FIG. 24C depicts an arrangement in which cells of the same type are arranged adjacently per-row.

Figure 24D:
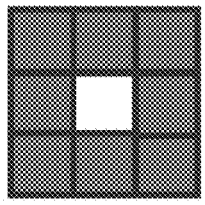

FIG. 24D depicts an arrangement in which cells of one type (e.g., type-A are surrounded by cells of a different type (e.g., type-B) but the different type are adjacent other cells of the same type (type-B in this example).

Figure 24E:
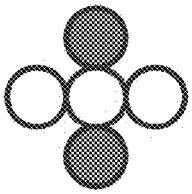

FIG. 24E depicts an arrangement in which the alternating arrangement provides adjacent relationships between cells of one type but not between cells of another type, and provides separation by row.

Figure 25:
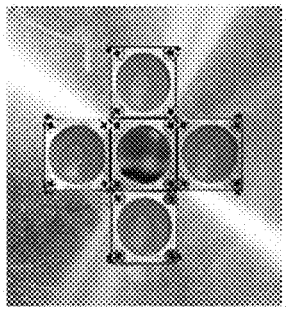
FIG. 25 is an image of cells having an alternating arrangement corresponding to that depicted in FIG. 24A.

FIG. 25 is an image of cells having an alternating arrangement corresponding to that depicted in FIG. 24A.

When sound waves are incident onto an elastic panel, they excite the vibration motion of the panel. The vibrating panel serves as a sound source, generating sound waves on the other side of the panel. The net result is that the sound waves have transmitted through the panel, which is what we want to reduce to the smallest value possible for noise blocking panels. In this configuration, the type-A cells will emit sound waves which are out of phase to that emitted by type-B cells. The configuration results in an out-of-phase relationship, which is achieved by using two or more cell types that have resonant frequencies that significantly differ from one another. These sound waves then cancel each other, resulting in minimum transmission, when the wavelength in air is much larger than the cell size. In one non-limiting example, the cell size is about 1.0 cm, and the wavelength is of the order of 100 cm.

The arrangement is based on a principle that the cancellation of the in-phase and out-of-phase motions of the neighboring cells is at a frequency of transmission minimum. This can lead to an overall cancellation of the net, averaged air motion on the other side of the membrane, so that when viewed as an aggregated source there is no net transmitted energy at the transmission minimum.

Compared to membrane reflectors having a single type of cell, the use of multiple types of cells has advantages in regard to the loading on the frame. That is, in actual large-area applications it is always necessary to use a frame which serves the purpose of assembling the individual membrane panels into a sound attenuation wall. In such situation if every membrane panel is identical, then at the total reflection frequency the loading on the frame can be very large, thereby leading to frame deformation and leakage of the low frequency sound. By using multiple cell types, since different cells (e.g., type-A and type-B cells) can be out of phase, their net loading on the frame may be minimized, so that there will be minimal low frequency sound leakage.

Figure 26:
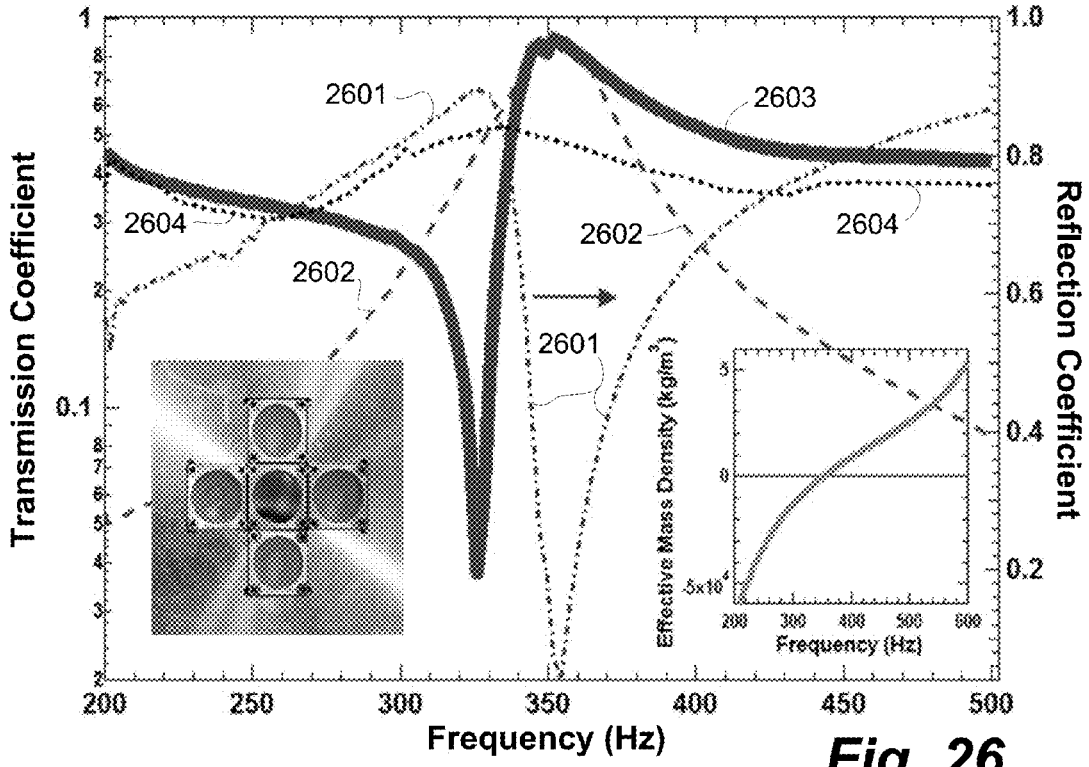
FIG. 26 is a graphical diagram showing the transmission coefficient vs. frequency and the reflection coefficient vs. frequency of a sound panel in which a pattern of 5 cells is used.
Figure 27:
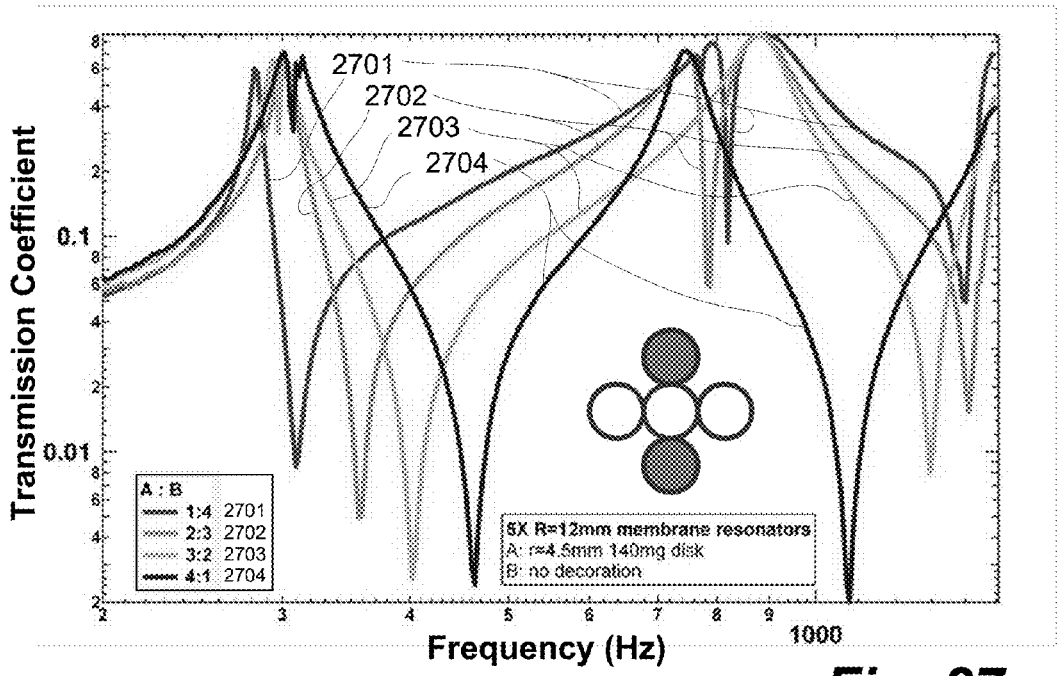
FIG. 27 is a graphical diagram showing the transmission coefficient vs. frequency of a sound panel in which a pattern of one type-A cell and four type-B cells is used.

FIGS. 26 and 27 are graphical diagrams showing frequency response of different patterns of cells. In FIG. 26, a pattern of 5 cells is used, as shown as an insert, and corresponding to the patterns of FIG. 24A and FIG. 25. Four filled cells include a membrane plus platelet (type-A cells), and the blank cell is empty (type-B cell). In FIG. 26, dash-dot line curve 2601 with the valley at 350 Hz is the transmission amplitude of four type-A cells when the type-B cell is blocked by a hard metal piece. Dashed line curve 2602 with the substantially symmetrical appearance is the transmission through the empty type-B cell in the middle when the four type-A cells are blocked. Thick curve 2603 with the valley at 325 Hz is the transmission when all cells are activated, which is 10 times lower than that of the empty cell alone. Dotted line 2604 running near the top of FIG. 26 represents sound reflection. The insert plot on the right side is the dynamic effective mass density.

In FIG. 27, a pattern of 5 cells corresponding to the pattern of FIG. 24E is used, as shown as an insert. Two filled cells consist of membrane plus platelet (type-A cells), and a row of blank cells have a membrane only (type-B cells). Transmission pattern 2701, showing a valley at 300 Hz, as the curve with the first valley is for one type-A cell and four type-B cells. Transmission pattern 2702, showing a valley at 360 Hz as the curve with the second valley is for two type-A cells and three type-B cells. Transmission pattern 2703, showing a valley at 400 Hz, as the curve with the third valley is for three type-A cells and two type-B cells. Transmission pattern 2704, showing a valley at 470 Hz, as the curve with the fourth valley is for four type-A cells and one type-B cell.

Solid Membranes Having Central Platelet

A working frequency at a wide variety of working frequencies, such as, by way of non-limiting example, from below 1 Hz to beyond 1 MHz, can be created. The materials for the membrane include all solids, and by proper selection of membrane materials, thickness, and lateral dimension, and the mass and dimension of the central platelet, sound attenuation structures with a desired working frequency can be created.

The sound attenuation panel affects sound transmission and absorption when the central platelet is displaced perpendicularly relative to the 2D array plane. As a result of the displacement, the membrane is deformed and a restoring force is exerted onto the platelet by the deformed membrane. Harmonic motion of the platelet and the membrane follows.

There are a number of eigenmodes at the resonant frequencies of the membrane-plus-platelet vibration system, which depend on the mass of the platelet and the lateral dimension of the membrane parallel to the 2D array plane and its thickness. At a certain frequency between two eigenfrequencies, which we call an anti-resonant frequency, the average displacement of the membrane-plus-platelet is zero. The system then behaves like a hard wall to far field sound radiation, and minimum transmission of the incident sound wave occurs. As Hooke's law is generally held for any solid, a membrane of any solid will in principle behave like a rubber membrane, for example in the rubber membrane of U.S. Pat. No. 7,395,898.

The membrane provides a restoring force to the central platelet when it is displaced. By choosing the right thickness and elasticity, such as the Young's module and the Poisson ratio, of the membrane, the mass and dimension of the platelet, and the cell dimension, working frequencies in the range from subsonic (below 1 Hz) to ultrasonic (above 1 MHz) can be covered. This resonance results from the existence of the restoring force exerting by the membrane when the central platelet is displaced. This can be achieved if the membrane is generally tight, rather than loose, but not necessarily pre-stretched as in U.S. Pat. No. 7,395,898. This works if the membrane is crease-free but the function does not go away if the amount of creases or wrinkle is small. In that case, creases are essentially imperfections caused by imperfect fabrication processes. The membrane can have thickness variation across the cell, as the general principle is still intact.

The structure can be realized through a number of fabrication techniques. One technique involves punching-through plastic sheet or metal sheet without soldering. The sheet can be formed by one-step molding, by sintering, or by photolithography if the structure is small.

Wrinkled and Corrugated Membranes

In typical metamaterials used for sonic sound panels, membranes used to support moving platelets were generally held tight and wrinkle-free. As an alternative, wrinkle patterns or corrugations are deliberately introduced into solid membranes. In such an arrangement, the materials selected for the solid membranes are generally rigid enough or stiff enough so the wrinkle patterns can be sustained when the membranes are in free-standing form.

The platelets arranged according to a planar or surface alignment, on a planar membrane, the non-planar providing flexibility in a direction of displacement of the platelets from the planar or surface alignment.

The wrinkled membranes have much smaller restoring force when displaced perpendicular to the membrane plane, as compared to their un-wrinkled counterparts. While it requires a large force to extend distort a flat form, a much smaller force is needed to distort a corrugated form of the same material. In part, this is because distortion of the corrugated form involves more of a twisting movement, resulting in greater moments of force about any given segment, and at the same time, requiring less stretching, elongation or linear distortion of the membrane. The wrinkled membranes provide an alternative way to tune the effective elasticity of the membranes onto which specific platelets are attached to form the desired resonant structures. With the introduction of wrinkles or corrugations, the working frequency of the structure can be much lowered as compared to the ones made of flat membrane of the same material. This allows the wrinkled membrane to rely, in part, on its shape to provide some of its flexibility and elasticity.

Figure 28A:
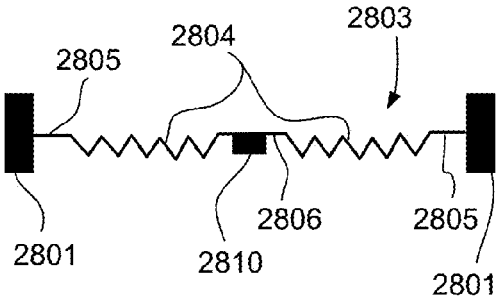
FIGS. 28A and 28B are schematic drawings of a sound attenuation structure with wrinkled membranes for sound blocking, using a single platelet per cell.
Figure 28B:
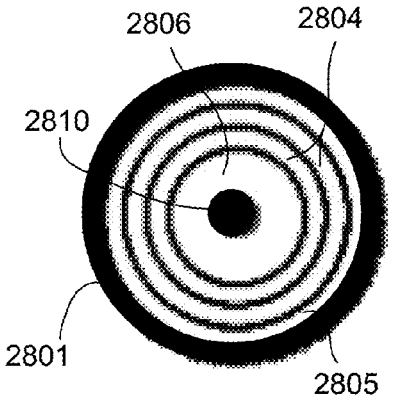

FIGS. 28A and 28B are schematic drawings of a sound attenuation structure with wrinkled membranes for sound blocking, using a single platelet per cell. FIG. 28A is a side view and FIG. 28B is a top or plan view. Depicted are hard frame 2801, membrane 2803 with corrugated section 2804 and flat sections 2805, 2806. Platelet 2810 of a predetermined mass is attached to and suspended on membrane 2803 on flat section 2806 and is circled by corrugated section 2804.

The wrinkles or corrugations are shown, by way of non-limiting example, in the form of concentric circle as corrugated section 2804 in the intermediate part of circular membrane 2803 with its outer boundary fixed to hard frame 2801. The central part 2806 and the outermost part 2805 of the membrane remains flat. Alternatively, the wrinkled pattern can be in other geometric shapes, such as square or hexagon, depending on the shape of the hard frame.

Figure 29A:
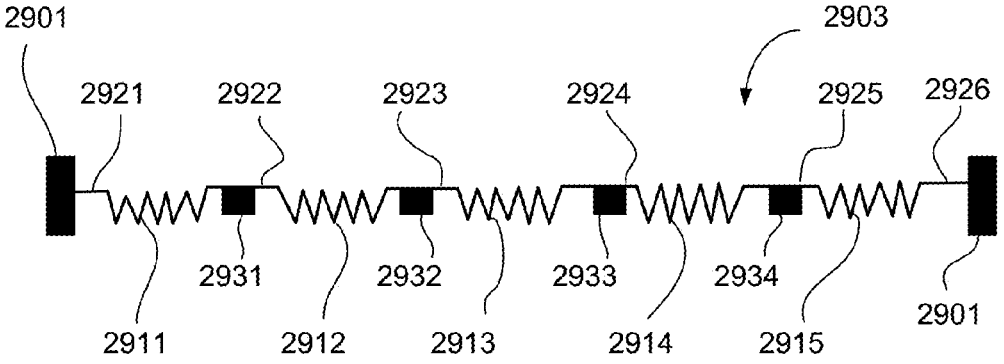
FIGS. 29A and 29B are schematic drawings of sound attenuation structures with wrinkled membranes for sound blocking, in which multiple platelets are attached to a wrinkled or corrugated membrane.
Figure 29B:
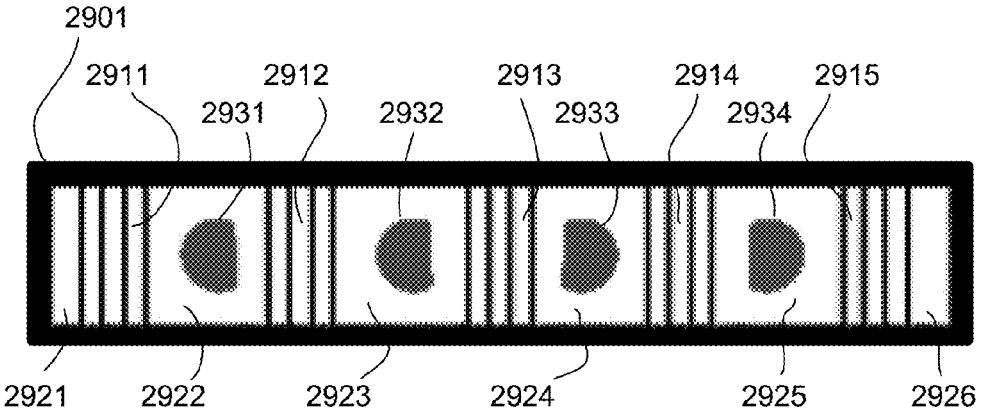

FIGS. 29A and 29B are schematic drawings of sound attenuation structures with wrinkled membranes for sound blocking, in which multiple platelets are attached to a wrinkled or corrugated membrane. FIG. 29A is a side view and FIG. 29B is a top or plan view. Depicted are hard frame 2901, membrane 2903 with corrugated sections 2911-2915 and flat sections 2921-2926. Platelets 2931-2934 are attached to and suspended on membrane 2903 on flat sections 2922-2925, with corrugated sections 2911-2915 suspending platelets 2931-2934 on membrane 2903. Platelets 2931-2934 can have substantially the same predetermined mass or multiple different predetermined masses.

The arrangement of FIGS. 29A and 29B uses wrinkles or corrugations in sections 2911-2915 in the form of parallel lines in some part of membrane 2903 with its outer boundary fixed on hard frame 2901.

Variations in Membrane Thickness

Figure 30A:
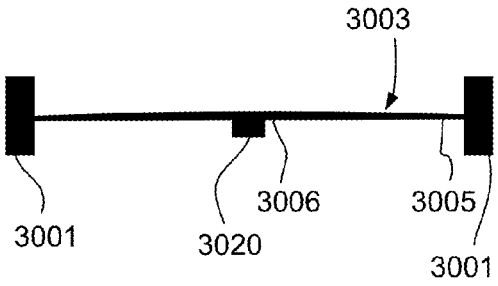
FIGS. 30A and 30B are schematic drawings of a sound attenuation structure in which the thickness of the sheet of solid materials varies across the cell so that a thin section is near the frame and a thicker section is near the center.
Figure 30B:
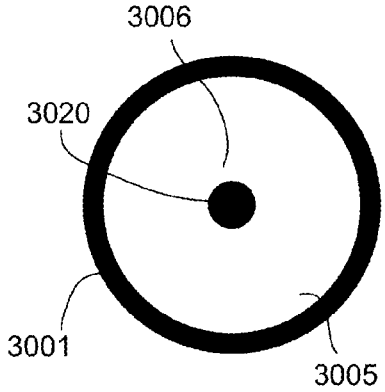

FIGS. 30A and 30B are schematic drawings of a sound attenuation structure in which the thickness of the sheet of solid materials varies across the cell. FIG. 30A is a side view and FIG. 30B is a top or plan view. Depicted are hard frame 3001, membrane 3003 with thin section 3005 near frame 3001 and thicker section 3006 at the center. Platelet 3020 of a predetermined mass is attached to and suspended on membrane 3003, where thicker section 3006 supports platelet 3020.

Figure 31A:
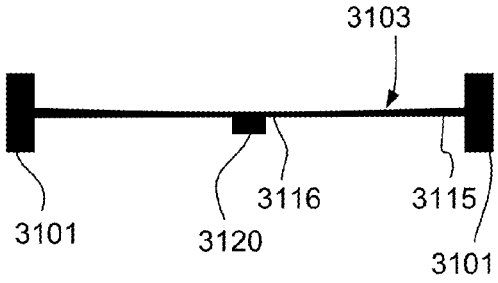
FIGS. 31A and 31B are schematic drawings of a sound attenuation structure in which the thickness of the sheet of solid materials varies across the cell so that a thick section is near the frame and a thinner section is near the center.
Figure 31B:
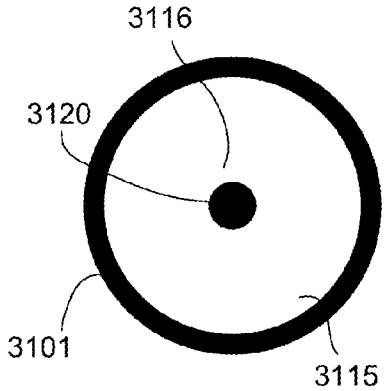

FIGS. 31A and 31B are schematic drawings of a sound attenuation structure in which the thickness of the sheet of solid materials varies across the cell. FIG. 31A is a side view and FIG. 31B is a top or plan view. Depicted are hard frame 3101, membrane 3103 with thicker section 3115 closest to frame 3101 and thinner section 3116 at the center. Platelet 3120 of a predetermined mass is attached to and suspended on membrane 3103, where thinner section 3116 supports platelet 3120.

Figure 32A:
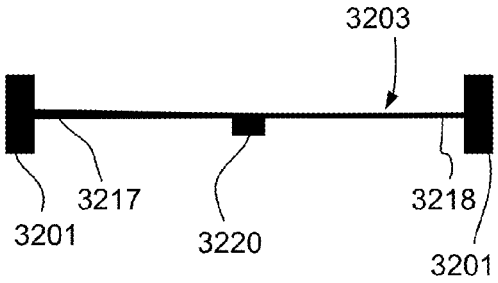
FIGS. 32A and 32B are schematic drawings of a sound attenuation structure in which the thickness of the sheet of solid materials varies across the cell so that a thick section is on one side.
Figure 32B:
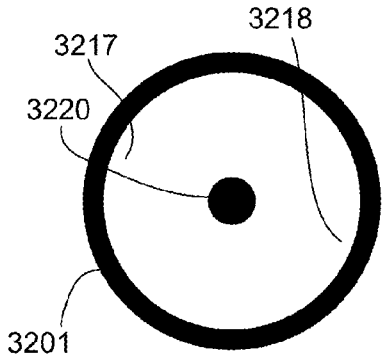

FIGS. 32A and 32B are schematic drawings of a sound attenuation structure in which the thickness of the sheet of solid materials varies across the cell. FIG. 32A is a side view and FIG. 32B is a top or plan view. Depicted are hard frame 3201, membrane 3203 with thicker section 3217 at one side and thinner section 3218 at another side. Platelet 3220 of a predetermined mass is attached to and suspended on membrane 3203.

CONCLUSION

It will be understood that many additional changes in the details, materials, steps and arrangement of parts, which have been herein described and illustrated to explain the nature of the subject matter, may be made by those skilled in the art within the principle and scope of the disclosed technology as expressed in the appended claims.

What is claimed is:

1. A sound attenuation panel comprising:

a substantially acoustically transparent planar, rigid frame divided into a plurality of individual, substantially two-dimensional cells;

a sheet of a flexible material fixed to the rigid frame, and a plurality of platelets fixed to the sheet of flexible material such that each individual cell of the plurality of cells is provided with a respective platelet, thereby establishing a resonant frequency, the resonant frequency defined by the planar geometry of the respective individual cells, the flexibility of the flexible material and said respective platelet thereon, and the resonant frequency tuned by adjusting at least one of a mass on the sheet of flexible material, said mass comprising one of said platelets, dimensions of the flexible material and tension on the flexible material; and the plurality of cells divided into at least two different types of the individual cells, distributed in a planar arrangement in an alternating fashion or according to a predetermined pattern on the sound attenuation panel, the different types of individual cells configured so that sound waves emitted by a first type of said different types of individual cells establishes a sound cancellation pattern with sound waves emitted by a second type of said different individual cells or an aggregation of different types of the individual cells.

2. The sound attenuation panel of claim 1, further comprising the different types of individual cells having a configuration comprising the planar geometry of the respective individual cells, the flexibility of the flexible material and said respective platelet thereon that establishes an out-of-phase relationship between sound waves emitted by at least two of the different types of individual cells.

3. The sound attenuation panel of claim 1, wherein at least a plurality of the cells comprise sizable orifices or openings through which air can flow freely sufficiently for providing or promoting air ventilation.

4. The sound attenuation panel of claim 1, further comprising each cell constructed into said least two different types of the individual cells as type-A cells and type-B cells arranged in a predetermined alternating pattern.

5. The sound attenuation panel of claim 4, wherein:

the type-A cells each comprise a sheet of elastic material fixed on the cell frame, and at least one platelet attached to the sheet; and the type-B cells each comprise a sheet of elastic material fixed on the cell frame, and either at least one platelet having a weight different from that of platelets attached to the type-A cells attached to the sheet, or without a platelet.

6. The sound attenuation panel of claim 4, wherein said platelets have a mass in the range of 0.1 to 10 g.

7. The sound attenuation panel of claim 4, wherein said sheet comprises multiple layers of said flexible material.

8. The sound attenuation panel of claim 4, wherein:

the sheet of flexible materials comprise impermeable flexible material.

9. A sound attenuation panel comprising:

a plurality of panels stacked together, wherein each panel of the plurality of panels comprises a rigid frame divided into a plurality of individual cells;

a sheet of a flexible material;

a plurality of platelets affixed to the sheet of flexible material such that each of the plurality of individual cells has attached thereto at least one of said platelets, whereby said cells have resonant frequencies defined by the planar geometry of each said individual cell, the flexibility of said flexible material and said respective platelet thereon, and the resonant frequency tuned by adjusting at least one of a mass on the sheet of flexible material, said mass comprising one of said platelets, dimensions of the flexible material and tension on the flexible material; and the plurality of cells divided into at least two different types of the individual cells, distributed in a planar arrangement in an alternating fashion or according to a predetermined pattern on the panel, the different types of individual cells configured so that sound waves emitted by a first type of said different types of individual cells establishes a sound cancellation pattern with sound waves emitted by a second type of said different individual cells or an aggregation of different types of the individual cells.

10. The sound attenuation panel of claim 9, further comprising the different types of individual cells having a configuration comprising the planar geometry of the respective individual cells, the flexibility of the flexible material and said respective platelet thereon that establishes an out-of-phase relationship between sound waves emitted by at least two of the different types of individual cells.

11. A sound attenuation panel comprising:

a substantially acoustically transparent planar, rigid frame divided into a plurality of individual, substantially two-dimensional cells;

a sheet of a flexible solid material fixed to the rigid frame, and a plurality of platelets fixed to the sheet of flexible material such that each cell is provided with a respective platelet, thereby establishing a resonant frequency, the resonant frequency defined by the planar geometry of the respective individual cells, the modulus of elasticity of the solid material and said respective platelet thereon, and the resonant frequency tuned by adjusting at least one of a mass on the sheet of flexible material, said mass comprising one of said platelets, dimensions of the flexible material and tension on the flexible material; and a membrane selected to provide a resonant characteristic for at least a subset of the cells, with selection criteria including at least one of thickness of the membrane, elasticity of the membrane, Young's modulus and the Poisson ratio of the membrane, the mass and dimension of the platelet, and the cell dimension, said resonant characteristic providing a selection of a working frequency in the range from subsonic (below 1 Hz) to ultrasonic (above 1 MHz).

12. The sound attenuation panel of claim 11, further comprising:

the plurality of cells divided into at least two different types of the individual cells, distributed in a planar arrangement in an alternating fashion or according to a predetermined pattern on the panel, the different types of individual cells configured so that sound waves emitted by a first type of said different types of individual cells establishes a sound cancellation pattern with sound waves emitted by a second type of said different individual cells or an aggregation of different types of the individual cells.

13. The sound attenuation panel of claim 11, wherein the thickness of the sheet of solid materials varies across the cell.

14. The sound attenuation panel of claim 11, further comprising:

multiple layers of said solid material.

15. The sound attenuation panel of claim 11, further comprising:

a plurality of panels stacked together wherein each said panel comprises a rigid frame divided into a plurality of individual cells, a sheet of a solid material, and a plurality of platelets, with each platelet fixed to said sheet of solid material to provide each cell with a respective platelet;

a working frequency of the sound attenuation structure defined by the planar geometry of the individual cells, the flexibility of said solid material, and said respective platelet thereon.

16. The sound attenuation panel of claim 15, further comprising:

each said panel formed with platelets having different weights from other said panels in the panel.

17. A sound attenuation panel comprising:

a substantially acoustically transparent planar, rigid frame divided into a plurality of individual, substantially two-dimensional cells;

a sheet of a flexible material fixed to the rigid frame, and a plurality of platelets fixed to the sheet of flexible material such that each cell is provided with a respective platelet, thereby establishing a resonant frequency, the resonant frequency defined by the planar geometry of the respective individual cells, the flexibility of the flexible material and said respective platelet thereon, and the resonant frequency tuned by adjusting at least one of a mass on the sheet of flexible material, said mass comprising one of said platelets, dimensions of the flexible material and tension on the flexible material; and the flexible material having a wrinkle or corrugation to permit distortion with reduced material elasticity, thereby permitting the flexible material to distort beyond that afforded by a planar material of the same type, while retaining mechanical strength in supporting the plurality of platelets.

18. The sound attenuation panel of claim 17, wherein the wrinkle or corrugation of the sheets results in the resonant frequencies of the cells by lowering the resonant frequencies as compared to that achieved by the use of flat membrane of the same material.

19. The sound attenuation panel of claim 17, wherein the thickness of the sheet of solid materials varies across the cell.

20. The sound attenuation panel of claim 17, further comprising:

multiple layers of said solid material.

21. The sound attenuation panel of claim 17, further comprising:

a plurality of panels stacked together wherein each said panel comprises a rigid frame divided into a plurality of individual cells, a sheet of a solid material, and a plurality of platelets, with each platelet fixed to said sheet of solid material to provide each cell with a respective platelet;

a working frequency of the sound attenuation structure defined by the planar geometry of the individual cells, the flexibility of said solid material, and said respective platelet thereon.

22. The sound attenuation panel of claim 21, further comprising:

each said panel formed with platelets having different weights from other said panels in the panel.

23. The sound attenuation panel of claim 17, further comprising:

adjacent frames facing each other with a distance having a predetermined relationship to the size of said frames.

24. The sound attenuation panel of claim 17, further comprising:

the cells comprising rigid plates, wherein the rigid plates have a flapping mode providing a tunable function whereby the frequency decreases in an approximate relationship to the inverse square root of the mass of plates.

25. The sound attenuation panel of claim 17, further comprising:

the cells comprising rigid plates, wherein the rigid plates have a flapping mode providing a tunable function whereby the flapping mode provides a tunable function based on the tunable resonant frequencies, said resonant frequencies tunable by varying the distance of separation between asymmetric plates, or the thickness, elasticity, such as the Young's module and the Poisson ratio, and the wrinkle patterns of the membrane, the mass of the plates, and the cell dimension.

26. The sound attenuation panel of claim 17, further comprising:

a plurality of plates in each unit cell.

27. The sound attenuation panel of claim 17, further comprising:

the cells forming structural units comprising masses subject to vibratory motion and the vibratory motion has resonant frequencies that increases or decreases by varying the lateral dimensions of the structural units, the membrane elasticity and wrinkle patterns, and the material type and dimension of the plates, thereby permitting selection of the resonant frequency as a lossy core.

* * * * *